US007325632B2

(12) United States Patent
Larsen et al.

(10) Patent No.: US 7,325,632 B2
(45) Date of Patent: Feb. 5, 2008

(54) NOZZLE BORE FOR PDC BITS

(75) Inventors: James Layne Larsen, Spring, TX (US); Dwayne P. Terracina, Spring, TX (US)

(73) Assignee: Smith International, Inc., Houston, TX (US)

( * ) Notice: Subject to any disclaimer, the term of this patent is extended or adjusted under 35 U.S.C. 154(b) by 316 days.

(21) Appl. No.: 11/215,310

(22) Filed: Aug. 30, 2005

(65) Prior Publication Data

US 2006/0054355 A1 Mar. 16, 2006

Related U.S. Application Data

(63) Continuation-in-part of application No. 10/788,258, filed on Feb. 26, 2004, now Pat. No. 7,040,423.

(51) Int. Cl.
*E21B 10/18* (2006.01)

(52) U.S. Cl. ..... 175/339; 175/340; 175/424

(58) Field of Classification Search ..... 175/339, 175/340, 424, 393

See application file for complete search history.

(56) References Cited

U.S. PATENT DOCUMENTS

| | | | |
|---|---|---|---|
| 1,738,860 | A | 12/1929 | Wigle |
| 2,963,102 | A | 12/1960 | Smith |
| 3,014,544 | A | 12/1961 | Steen |
| 3,111,179 | A | 11/1963 | Albers et al. |
| 3,129,777 | A | 4/1964 | Haspert |
| 3,220,754 | A | 11/1965 | Mori |
| 3,358,783 | A | 12/1967 | Raynal et al. |
| 3,645,346 | A | 2/1972 | Miller et al. |
| 4,174,759 | A | 11/1979 | Arbuckle |
| 4,391,339 | A | 7/1983 | Johnson, Jr. et al. |
| 4,392,534 | A | 7/1983 | Miida |
| 4,505,342 | A | 3/1985 | Barr et al. |
| 4,533,004 | A | 8/1985 | Ecer |
| 4,542,798 | A | 9/1985 | Madigan |
| 4,567,954 | A | 2/1986 | Voight, III et al. |

(Continued)

FOREIGN PATENT DOCUMENTS

| | | |
|---|---|---|
| EP | 0 669 449 A2 | 6/1996 |

(Continued)

OTHER PUBLICATIONS

Combined Search and Examination Report issued in corresponding British Application No. GB0603813.7; Dated Jun. 14, 2006; 5 pages.

(Continued)

*Primary Examiner*—Frank Tsay
(74) *Attorney, Agent, or Firm*—Osha Liang LLP

(57) ABSTRACT

An earth boring bit includes a bit body including plurality of PDC cutter elements and a fluid plenum connecting a fluid inlet to at least one fluid orifice. Furthermore, a ledge formed between a bottom of the fluid plenum and the at least one fluid orifice includes a relief region formed therein located across a flow change angle. Additionally, a method to improve a polycrystalline diamond compact drill bit body design includes determining flow change angles from a fluid plenum into a fluid orifice and modeling a relief region on a ledge to optimize fluid into the fluid orifice.

31 Claims, 23 Drawing Sheets

U.S. PATENT DOCUMENTS

| | | | | |
|---|---|---|---|---|
| 4,603,750 | A | 8/1986 | Sorenson | |
| 4,640,375 | A | 2/1987 | Barr et al. | |
| 4,676,324 | A | 6/1987 | Barr et al. | |
| 4,687,066 | A | 8/1987 | Evans | |
| 4,727,946 | A | 3/1988 | Barr et al. | |
| 4,739,845 | A | 4/1988 | Dennis | |
| 4,759,415 | A * | 7/1988 | Pessier | 175/340 |
| 4,775,017 | A | 10/1988 | Forrest et al. | |
| 4,794,995 | A | 1/1989 | Matson et al. | |
| 5,173,880 | A | 12/1992 | Duren et al. | |
| 5,414,674 | A | 5/1995 | Lichman | |
| 5,538,093 | A | 7/1996 | Siracki et al. | |
| 5,579,855 | A | 12/1996 | Dickey | |
| 5,583,825 | A | 12/1996 | Carrazzone et al. | |
| 5,669,459 | A | 9/1997 | Larsen et al. | |
| 5,671,136 | A | 9/1997 | Willhoit, Jr. | |
| 5,966,672 | A | 10/1999 | Knupp | |
| 5,992,763 | A | 11/1999 | Smith et al. | |
| 6,079,507 | A * | 6/2000 | Trujillo et al. | 175/57 |
| 6,135,218 | A | 10/2000 | Deane et al. | |
| 6,142,248 | A | 11/2000 | Thigpen et al. | |
| 6,186,251 | B1 | 2/2001 | Butcher | |
| 6,311,793 | B1 | 11/2001 | Larsen et al. | |
| 6,311,973 | B1 * | 11/2001 | Tanaka et al. | 271/314 |
| 6,390,212 | B1 | 5/2002 | Wood | |
| 6,581,702 | B2 | 6/2003 | Dickey | |
| 6,698,538 | B2 | 3/2004 | Kristiansen et al. | |
| 2001/0030066 | A1 | 10/2001 | Clydesdale et al. | |
| 2002/0050408 | A1 | 5/2002 | Nackerud | |
| 2002/0092684 | A1 | 7/2002 | Singh et al. | |
| 2002/0108752 | A1 | 8/2002 | Morey et al. | |
| 2002/0112889 | A1 | 8/2002 | Larsen | |
| 2002/0148649 | A1 | 10/2002 | Dickey | |
| 2003/0010532 | A1 | 1/2003 | Kristiansen et al. | |
| 2003/0019333 | A1 | 1/2003 | Scott | |
| 2003/0164250 | A1 | 9/2003 | Wardley | |
| 2003/0192718 | A1 | 10/2003 | Buckman et al. | |
| 2004/0069534 | A1 | 4/2004 | Larsen et al. | |
| 2004/0069540 | A1 | 4/2004 | Kriesels et al. | |
| 2004/0226751 | A1 | 11/2004 | McKay et al. | |
| 2004/0238224 | A1 | 12/2004 | Runia | |

FOREIGN PATENT DOCUMENTS

| | | | |
|---|---|---|---|
| EP | 0 669 449 | A3 | 6/1996 |
| GB | 2 277 758 | A | 11/1994 |
| GB | 2 294 073 | A | 4/1996 |
| GB | 2 295 839 | A | 6/1996 |
| GB | 2 307 927 | A | 6/1997 |
| GB | 2 324 109 | A | 10/1998 |
| GB | 2 361 728 | A | 10/2001 |
| GB | 2 384 014 | A | 7/2003 |
| GB | 2 411 418 | A | 8/2005 |
| GB | 2 423 543 | A | 8/2006 |

OTHER PUBLICATIONS

Combined Search and Examination Report issued on corresponding British Application No. GB0617009.6; Dated Dec. 19, 2006; 6 pages.

* cited by examiner

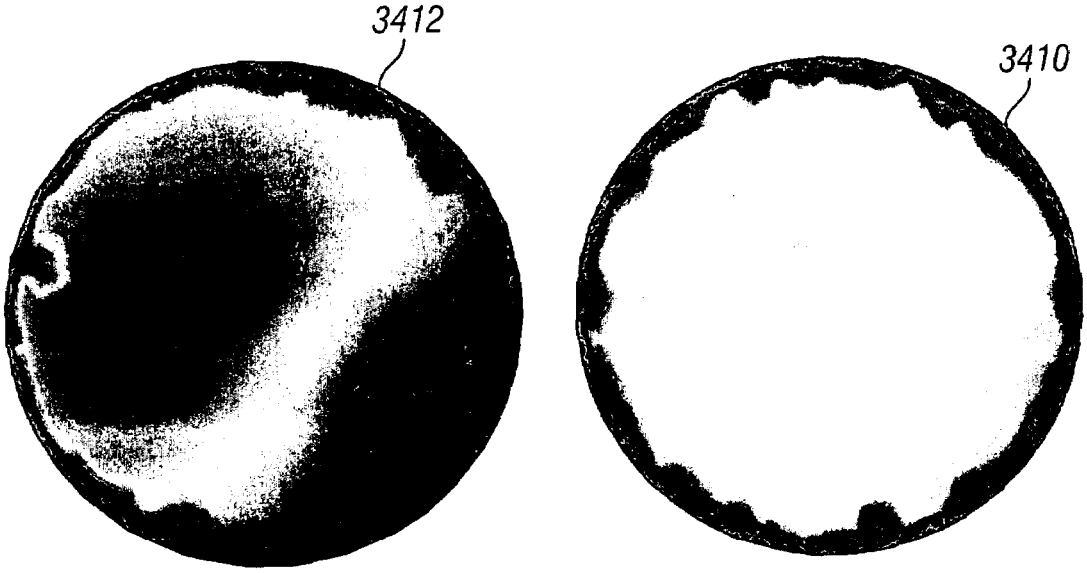
FIG. 29
FIG. 30
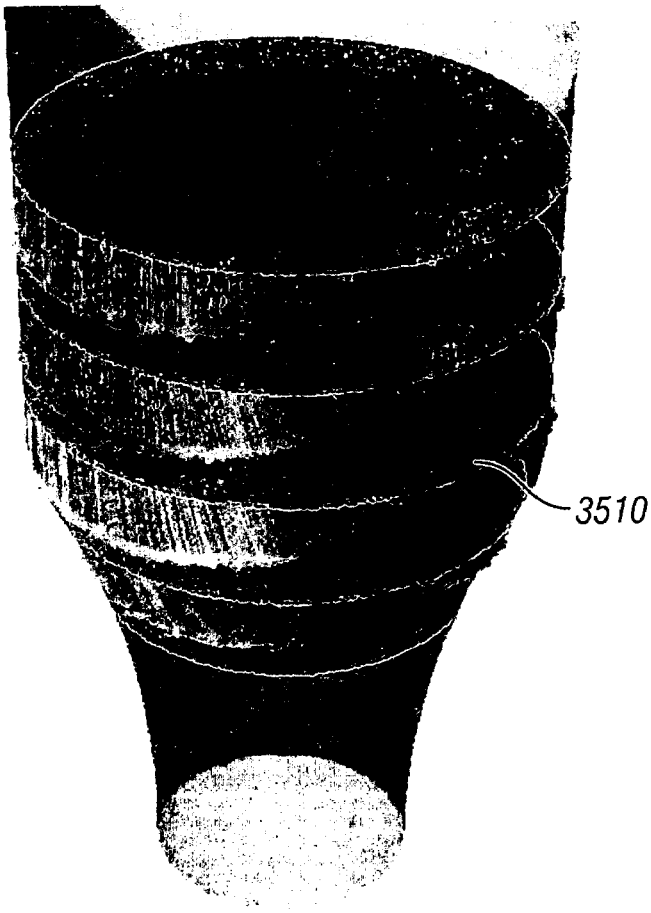

NOZZLE BORE FOR PDC BITS

CROSS-REFERENCE TO RELATED APPLICATIONS

The present application is a Continuation in Part of U.S. patent application Ser. No. 10/788,258, entitled "Improved Nozzle Bore for High Flow Rates" filed Feb. 26, 2004 now U.S. Pat. No. 7,040,423 by Larsen, et al., incorporated by reference herein.

BACKGROUND OF INVENTION

1. Field of the Invention

The present invention relates generally to Polycrystalline Diamond Compact (PDC) drill bits and their methods of manufacture. More particularly, the present invention relates to methods and apparatus to improve and manufacture the internal hydraulics of a PDC drill bit. More particularly still, the present invention relates to methods and apparatus to improve the flow characteristics of drilling mud through nozzles of PDC drill bits to minimize areas of flow separation therethrough.

2. Background Art

FIG. 1 shows a typical rotary drilling rig. A drill bit 10 is connected to the end of a drill string 12. Drilling fluid, typically referred to as mud, is pumped through the drill string 12 into the drill bit 10 by surface equipment 11. The mud performs a variety of functions. For example, the mud cools the drill bit 10, cleans the cutting structures, helps penetrate the formation, and carries the cuttings to the surface. To accomplish these tasks, a high flow rate of mud must be maintained while drilling. The desired flow rate is often as high as possible based on the surface equipment 11, pressure losses in the drill string 12, and the capabilities of the equipment in the drill string 12 to handle the flow.

Drill bits used to drill wellbores through earth formations generally fall within one of two broad categories of bit structures. Drill bits in the first category are known as "roller cone" drill bits. Drill bits of this type usually include a bit body having a plurality of legs, each having at least one roller cone rotatably mounted thereto. Typically, roller cone drill bits are constructed as three-leg bits, but two leg and single leg drill bits are available. As the roller cone bit is rotated in contact with the formation, cutter elements mounted about the periphery of each roller cone roll over the bottom hole formation, scraping and pulverizing the formation into small pieces that are carried to the surface with the returning annular fluid. An example of a prior art roller cone bit is shown in FIG. 2. The roller cone bit includes a bit body 215 having at least one roller cone 214 rotatably mounted thereto. The roller cone bit body 215 is commonly made from a plurality of legs, in this example three, that are welded together.

FIG. 3 illustrates a cross-section of one leg 301 of a prior art roller cone bit. The joining of the legs forms a fluid inlet 308 and an internal plenum 304. At least one fluid orifice 307 is typically machined in leg 301. The fluid orifice 307 comprises an entrance 302, a nozzle seat 306, an O-ring gland 310, and a receptacle 311 designed for the attachment of a nozzle 313. During drilling, fluid, not shown, enters the bit body 215 at the fluid inlet 308 and continues into the fluid plenum 304. The fluid is forced against a bottom of the fluid plenum 305 until it reaches the fluid orifice 307 where it exits the bit body 215 through the nozzle 313.

Drill bits of the second category are commonly known as "fixed cutter" or "drag" bits. Bits of this type usually include a bit body formed from steel or a matrix material upon which a plurality of cutting elements is disposed. Most commonly, the cutting elements disposed about the drag bit are manufactured of cylindrical or disc-shaped materials known as polycrystalline diamond compact, or PDC. Polycrystalline diamond compact cutters are of extraordinary hardness and drill through the earth by scraping away the formation rather than pulverizing it. For this reason, fixed cutter and drag bits are often referred to as "PDC" bits. Like their roller-cone counterparts, PDC bits also include an internal plenum through which fluid in the bore of the drillstring is allowed to communicate with a plurality of fluid nozzles.

Referring still to FIG. 3, the fluid velocity within the fluid plenum 304 is relatively low. However, as the fluid moves into the fluid orifice 307, it accelerates due to the reduction of flow area. Significantly, the increased fluid velocity through the fluid orifice 307 can cause internal erosion of the drill bit. Internal erosion in a drill bit may typically be related to four parameters: mud weight, mud abrasiveness, flow velocity, and geometrical discontinuities. Over time, the drilling industry has found the need to increase the flow rates through the drill bits, making internal erosion of the fluid orifices a significant source of concern. A ledge 314 formed between the bottom of fluid plenum 305 and fluid orifice 307 is particularly troublesome in drill bits. High flow rates cause the fluid flow to separate at ledge 314 creating recirculation zones that may have sufficient energy to erode the surrounding metal surface. A "washout" occurs when the erosion progresses such that a hole is formed in the bit body 215 that allows the fluid to bypass the nozzle. The washout results in a loss of pressure in the system and requires pulling the drill bit out of the hole to be replaced. This costs the driller a great deal of time and money.

FIG. 4 illustrates one prior art solution disclosed in U.S. Pat. No. 5,538,093 (the '093 Patent), incorporated by reference herein. In the '093 Patent, a sleeve 409 is welded inside of the fluid orifice 307. Sleeve 409 comprises a smoothly contoured fluid entrance 403 which gradually reduces the flow area in preparation for entrance into a nozzle, not shown, at a nozzle seat 406. Fluid entrance 403 helps to eliminate the separation of the fluid and, therefore, reduce the amount of internal erosion. One drawback of this approach is that the sleeve 409 requires a significant amount of space to be effective. As a result, this approach is only available for the large drill bit sizes (i.e., those bits having diameters greater than 11").

Small drill bits (i.e., those bits having diameters less than 11") are typically unable to accommodate sleeves in the fluid orifices because there is not sufficient room in the interior of the bit to accommodate the required large fluid orifice without cutting into the side of the bit or into areas reserved for the bit lubrications system, not shown. FIGS. 5 and 6 illustrate a typical small drill bit. To fit a nozzle, not shown, a fluid orifice 505 is usually drilled into the bit body 508 through a bottom of the fluid plenum 504. A nozzle receptacle 509 is then formed inside fluid orifice 505 for the attachment of the nozzle. The drilling of fluid orifice 505 leaves a ledge 506 formed between the bottom of fluid plenum 504 and fluid orifice 505. Depending on the flow rate and the geometry of the particular drill bit, ledge 506 can cause fluid separation to occur with sufficient energy to erode bit body 508 which can lead to a washout. Manufacturing options to remove ledge 506 are limited due to the limited space and accessibility to ledge 506 by machining tools.

A prior art solution for small drill bits is shown in FIG. 9. A drill is inserted through the fluid orifice 505 to machine a relief region 901 substantially towards the bit body axis, not shown. While such a relief region provides some improvements in the flow, such a region fails to fully solve the erosion problems present at higher flow rates.

What is still needed, therefore, are drill bits and methods for designing and manufacturing drill bits having improved internal flow characteristics.

SUMMARY OF INVENTION

According to one aspect of the invention, an earth boring bit includes a bit body adapted to connect a drill string and a plurality of PDC cutter elements mounted on the bit body, wherein the bit body includes a fluid plenum connecting a fluid inlet to at least one fluid orifice, and wherein a ledge formed between a bottom of the fluid plenum and the at least one fluid orifice has a relief region formed therein located across a flow change angle.

According to another aspect of the invention, a method of improving a polycrystalline diamond compact drill bit body design having formed therein a fluid plenum in communication with a fluid inlet and at least one fluid orifice, wherein a ledge is formed between a bottom of the fluid plenum and the at least one fluid orifice including determining flow change angles from the fluid plenum of the drill bit into the fluid orifice, and modeling a relief region on the ledge to optimize flow into the at least one fluid orifice.

According to another aspect of the invention, a method of manufacturing a polycrystalline diamond compact bit body with improved flow characteristics having formed therein a fluid plenum in communication with a fluid inlet and at least one fluid orifice, wherein a ledge is formed between a bottom of the fluid plenum and the at least one fluid orifice including forming a relief region on the ledge.

According to another aspect of the invention, a polycrystalline diamond compact drill bit includes a bit body having a connection adapted to connect to a drill string, wherein the bit body includes a fluid plenum configured to be in fluid communication with a fluid inlet and at least one fluid orifice, a plurality of PDC cutters positioned upon the bit body, and each of the at least one fluid orifice comprising a fluid orifice entrance area, a relief region, a nozzle entrance area, and a nozzle receptacle, wherein the fluid orifice entrance area is at least 20 percent larger than the nozzle entrance area.

Other aspects and advantages of the invention will be apparent from the following description and the appended claims.

BRIEF DESCRIPTION OF DRAWINGS

FIG. 29 shows a comparative velocity contour plot of a PDC nozzle bore with and without a radius at the intersection with a fluid plenum.

FIG. 30 shows a sectioned velocity contour plot of a PDC nozzle bore with no radius at its intersection with a fluid plenum.

DETAILED DESCRIPTION

In one or more embodiments, the present invention relates to forming at least one relief region on a ledge formed between a bottom of the fluid plenum and a fluid orifice inside of a bit body. Further, embodiments of the present invention provide drill bits and methods of forming drill bits having improved internal flow characteristics when compared with prior art drill bits.

Figure 1:
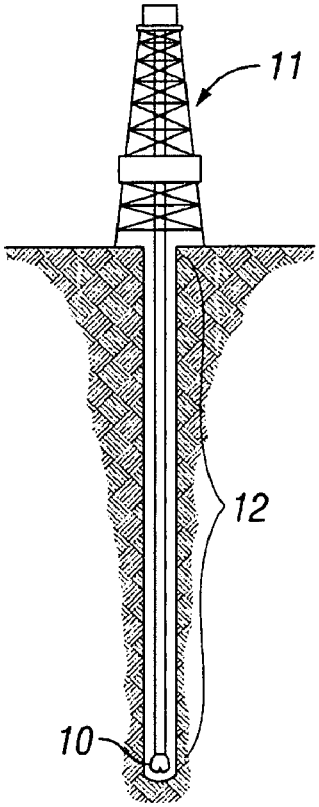
FIG. 1 (Prior Art)
FIG. 1 shows a typical rotary drilling rig, including surface equipment, drill string, and drill bit.
Figure 2:
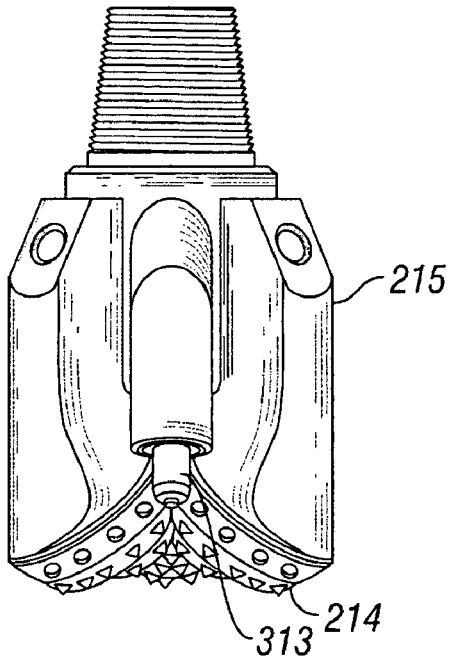
FIG. 2 (Prior Art)
FIG. 2 shows a prior art rotary cone bit.
Figure 3:
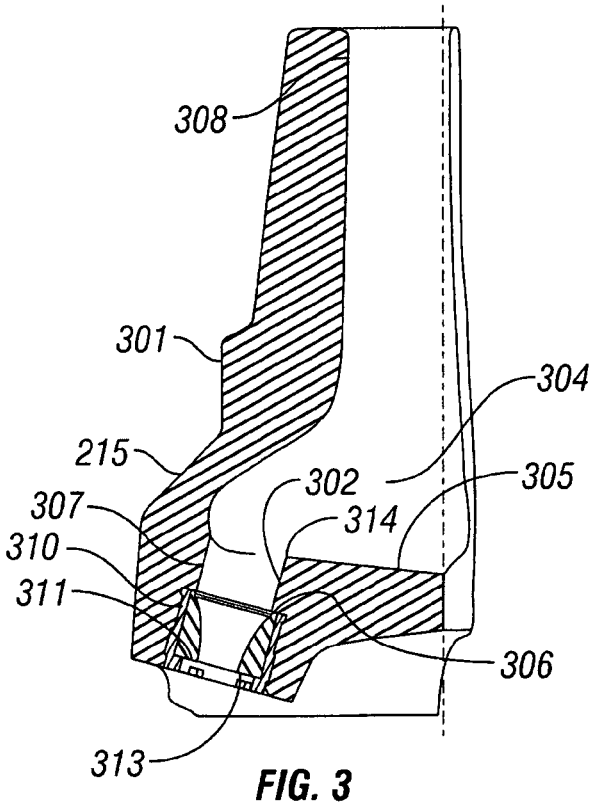
FIG. 3 (Prior Art)
FIG. 3 shows a cross-section of a leg of a prior art rotary cone bit.
Figure 4:
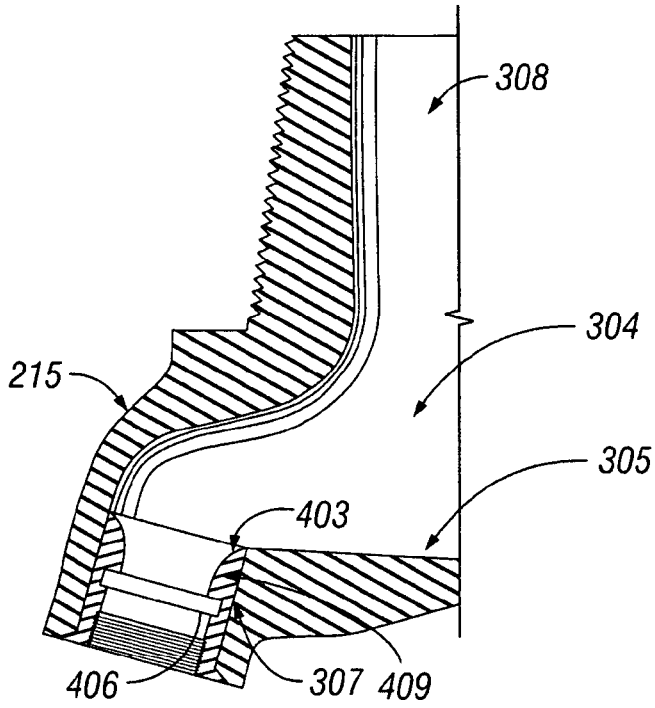
FIG. 4 (Prior Art)
FIG. 4 shows a cross-section of a leg of a prior art rotary cone bit.
Figure 5:
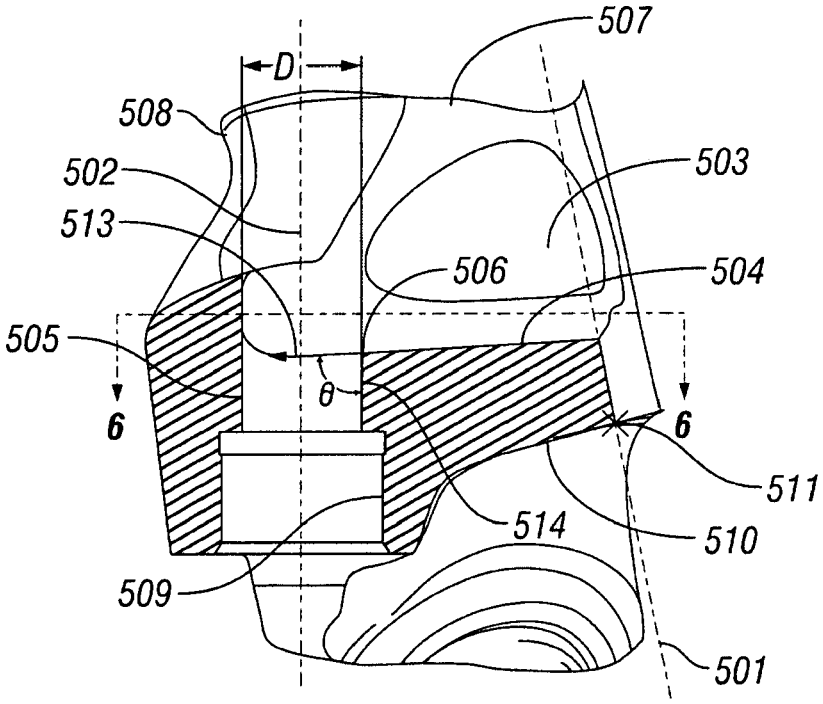
FIG. 5 (Prior Art)
FIG. 5 shows a cross-section of a leg of a prior art rotary cone bit.
Figure 6:
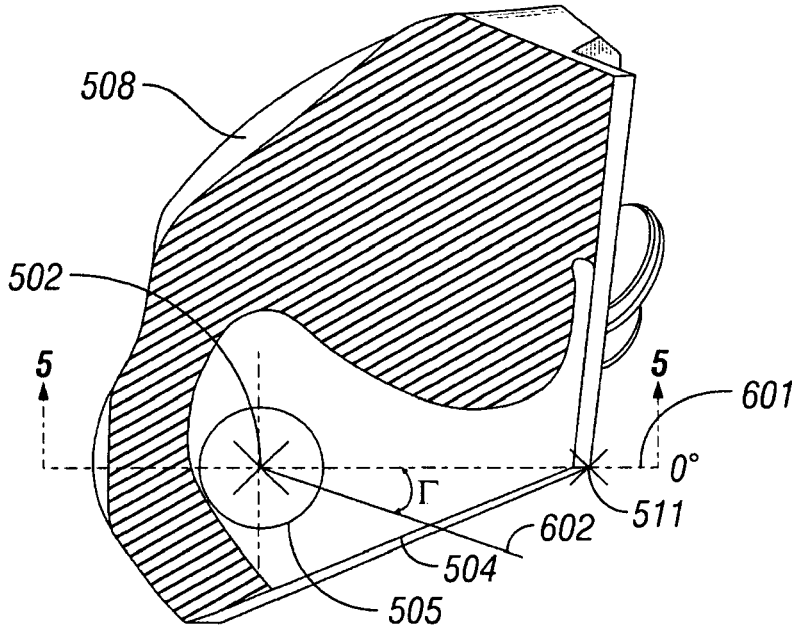
FIG. 6 (Prior Art)
FIG. 6 shows a bottom of a fluid plenum of the leg of the prior art rotary cone bit of FIG. 5.

To provide understanding of aspects of the present invention, FIGS. 5 and 6 explain and clarify the terminology and state of the prior art. As discussed in the background, some small prior art drill bits (e.g., those having a diameter less than 11") have experienced significant problems due to internal erosion. FIGS. 5 and 6 show cross-sections of a leg of a prior art bit body 508 after a fluid orifice 505 has been formed in the bit body 508. Fluid orifice 505 has been formed with a drill bore having a diameter "D," an entrance formed by ledge 506, and a nozzle receptacle 509 configured for the receipt of an erosion resistant nozzle, not shown. FIG. 5 is a cross-section at a datum plane 601 (shown in FIG. 6) formed by a fluid orifice axis 502 and a point 511 on a bit body axis 501. The point 511 is located where the bit body axis 501 intersects a dome 510 of the bit body 508.

FIG. 6 is a view at the distal end of the drill bit, normal to fluid orifice axis 502. The term "distal end," as used herein, refers to the portion of the bit body furthest from an inlet 507. The datum plane 601 is illustrated in FIG. 6 as a line drawn from bit body axis 501 to point 511. This line (which is coincident with the datum plane 601) is notated as 0°. For reasons described below, in order to describe embodiments of the present invention, several angles are defined. The angles ($\Gamma$, $\alpha$, and $\beta$), which are discussed below, are oriented relative to datum plane 601. Reference to any angle ($\Gamma$, $\alpha$, and $\beta$), in this description, is positive for clockwise rotation about fluid orifice axis 502 based on the view toward the distal end of the bit body.

As discussed above, during drilling, fluid, not shown, enters bit body 508 at inlet 507 and continues into fluid plenum 503. The fluid is forced against the bottom of fluid plenum 504 until it reaches ledge 506 formed between the bottom of fluid plenum 504 and fluid orifice 505. The fluid follows an angle $\theta$ ("flow change angle") at ledge 506 to enter into fluid orifice 505 and exit bit body 508. A nozzle, not shown, is typically fixed in a nozzle receptacle 509.

The flow change angle $\theta$ may be determined by examining two-dimensional ("2-D") cross-sections that are oriented relative to datum plane 601 illustrated in FIG. 6. A 2-D cross-section 602 is a plane rotated about the fluid orifice axis 502 at an angle $\Gamma$ relative to the datum plane 601. In FIG. 5, the angle $\Gamma$ is 0°. In the 2-D cross-section 602, flow change angle $\theta$ is the angle between a curve 513 and a curve 514. Curve 513 is defined by extending a curve toward the fluid orifice axis 502 tangent to the bottom of the fluid plenum 504 at the ledge 506. Curve 514 is the curve created by the cross-section 602 of the fluid orifice 505. Because the fluid orifice 505 is generally a drilled hole, curve 514 is usually a straight line. The flow change angle $\theta$ has particular importance in determining the amount of fluid separation and, therefore, the risk of internal erosion of the bit body 508 due to high flow rates. A greater flow change angle $\theta$ results in increased fluid separation.

Figure 7:
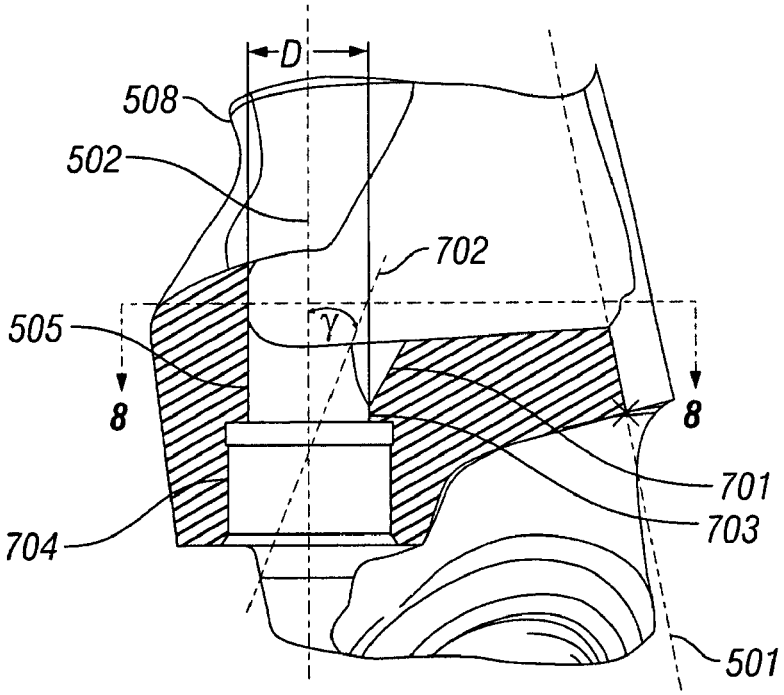
FIG. 7 shows a cross-section of a leg of a rotary cone bit in accordance with one embodiment of the invention.
Figure 8:
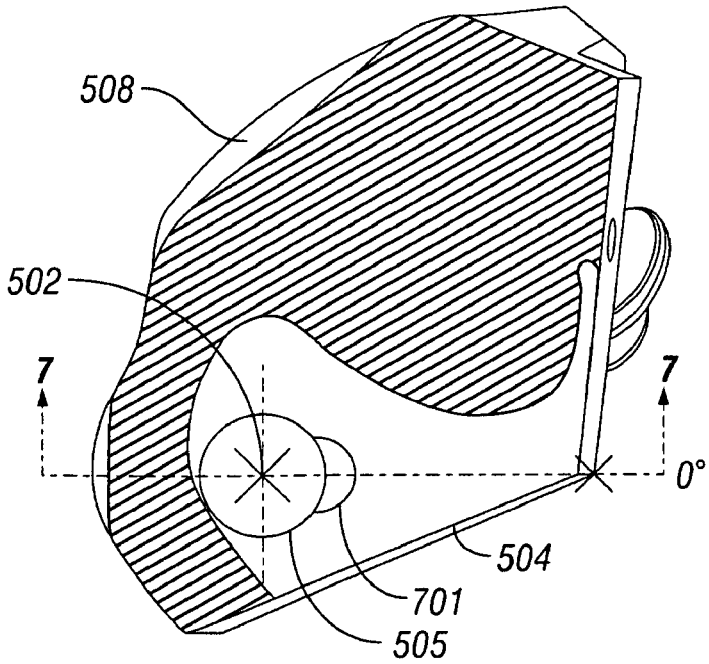
FIG. 8 shows a bottom of a fluid plenum of the leg of the rotary cone bit of FIG. 7.

FIGS. 7 and 8 show cross-sections of an embodiment of the invention. A relief region 701 has been formed on the ledge 506 coincident with the datum plane 601 (angle $\alpha$=0 degrees). Relief region 701 intersects the cylindrical bore 703 of the fluid orifice 505 above the entrance into a nozzle, not shown, that is installed in the nozzle receptacle 704. The angles $\Gamma$, $\alpha$, and $\beta$ each refer to a rotation about the fluid orifice axis 502 relative to the datum plane 601. The angles $\alpha$ and $\beta$ refer to the locations of relief regions. Those having ordinary skill in the art will appreciate that other methods for defining the location of relief regions may be devised without departing from the scope of the present invention. For example, one could locate relief regions based on a reference plane defined by the bit body axis and a point on the fluid orifice axis.

A relief region 701 is formed at an angle $\gamma$ on the ledge 506. The angle $\gamma$ is defined herein as the angle of the relief region axis 702 with respect to the fluid orifice axis 502. The magnitude of angle $\gamma$ may be limited by interference between the bit body 508 and the rotary machining tool. In the prior art, relief region is formed by a drill, not shown, which is inserted through fluid orifice 505. The relief region 701 reduces the magnitude of the flow change angle $\theta$. Those having ordinary skill in the art will appreciate that the relief region could be located without referencing the fluid orifice axis without departing from the scope of the invention.

Figure 9:
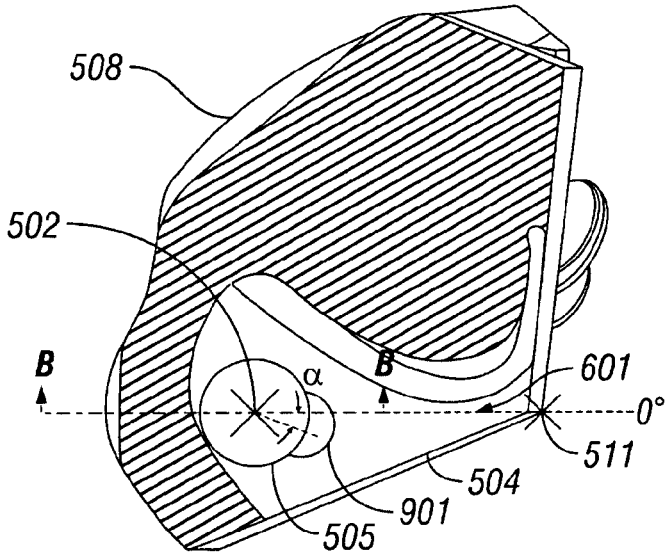
FIG. 9 (Prior Art)
FIG. 9 shows a bottom of a fluid plenum of a leg of a prior art rotary cone bit.

Turning to FIG. 9, a bottom of fluid plenum 504 of a leg of a prior art rotary cone bit is shown. In the prior art, the relief region 901 has been formed in the range of $\alpha$=7° to 15°. FIG. 9 illustrates relief region 901 that has been formed by inserting a drill, not shown, through fluid orifice 505. The relief region 901 has been formed at the angle $\alpha$ equal to 15 degrees with respect to datum plane 601.

Figure 10:
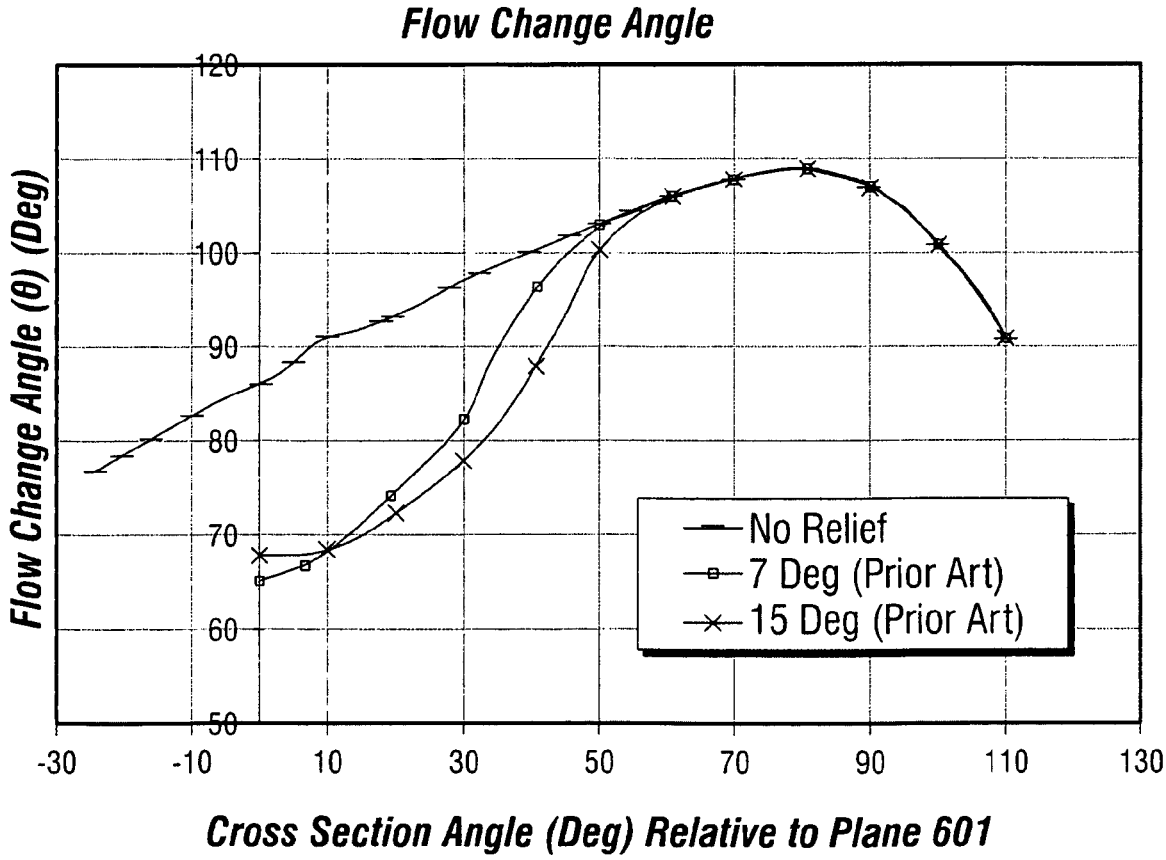
FIG. 10 (Prior Art)
FIG. 10 shows a graph of flow change angles versus cross-section angles for a prior art rotary cone bit.

FIG. 10 illustrates the variance or difference of flow change angle $\theta$ that results from the prior art relief region. The relief region of the prior art in the range of an angle $\alpha$ of about 7° to 15° decreases the flow change angle $\theta$ for a range of 2-D cross-section angles. The graph illustrates that the prior art relief region fails to reduce the flow change angle $\theta$ where it is at the highest value. Changing the location of the relief region or forming additional relief regions may advantageously reduce the flow change angle θ where it is highest.

Figure 11:
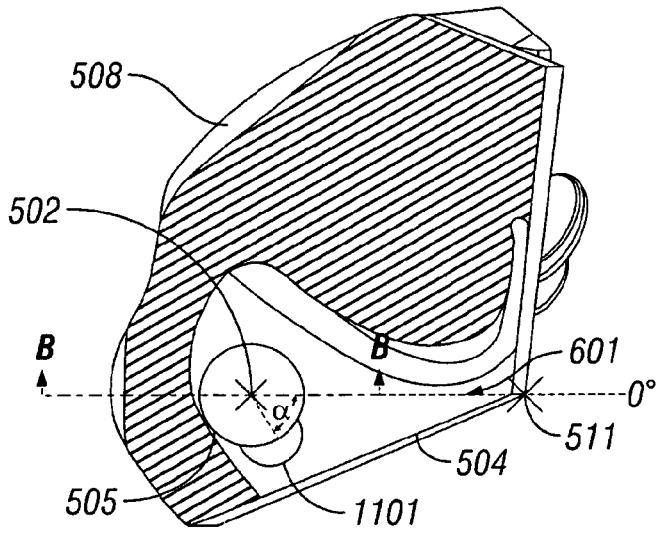
FIG. 11 shows a bottom of a fluid plenum of a leg of a rotary cone bit in accordance with one embodiment of the invention.

Turning to FIG. 11, a cross-section of an embodiment of the invention is shown. In FIG. 11, an embodiment is characterized by a single relief region 1101 formed on ledge (506 of FIG. 5) and located at an angle α relative to datum plane 601. The angle α has a value of about 65° in this embodiment. In other embodiments, an angle α between 20° and 150° may be preferred. Those having ordinary skill in the art will appreciate that relief region 1101 may be located at other angles without departing from the scope of this invention.

Figure 12:
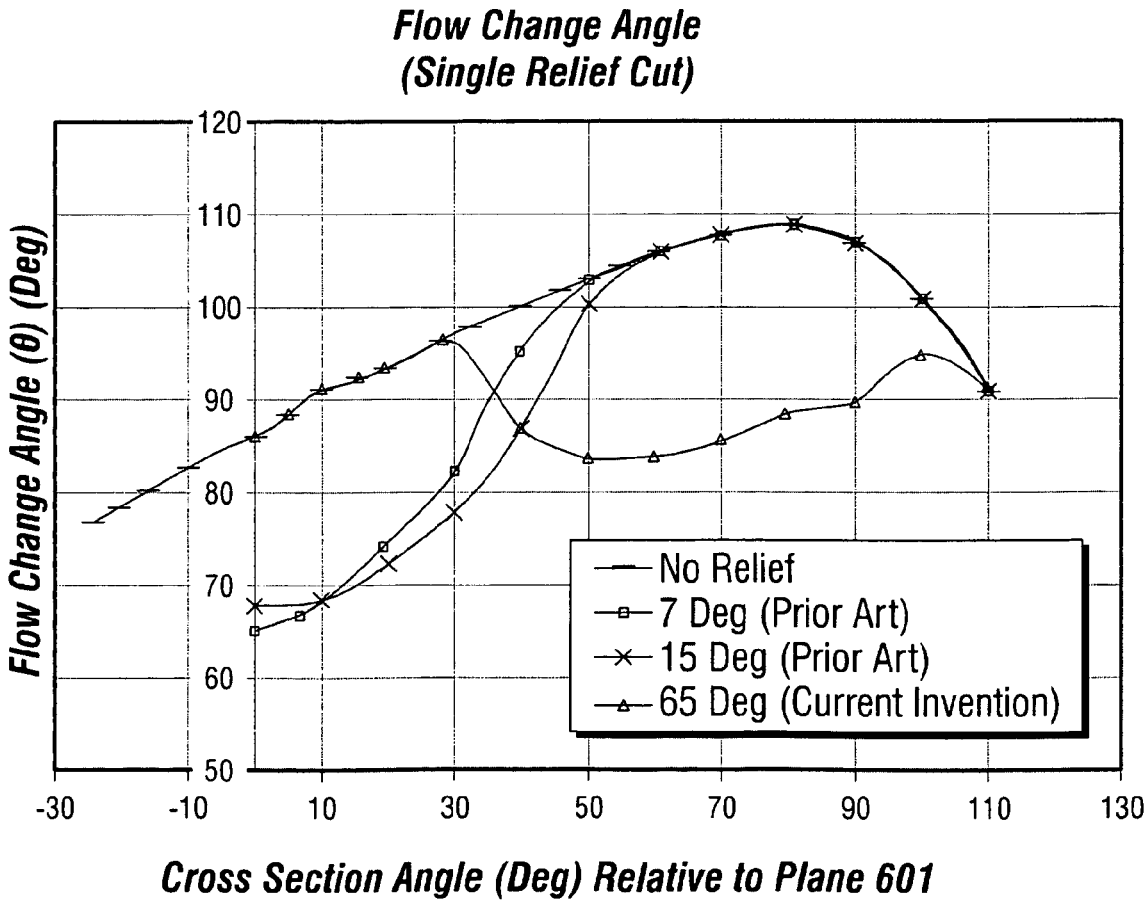
FIG. 12 shows a graph of flow change angles versus cross-section angles in accordance with one embodiment of the invention.

FIG. 12 illustrates the reduction of the flow change angle θ in a range of 2-D cross-section angles after relief region 1101 has been located as shown in FIG. 11. The highest flow change angle θ is lower than the prior art when the relief region is located at an angle α of 65°. The decrease in flow change angle θ will vary according to the specific geometry of the bit body and the orientation of the fluid orifice. FIG. 12 only illustrates the reduction in the flow change angle θ for one embodiment of the invention. This graph illustrates that an angle α equal to 30° to 50° may be preferred in other embodiments. In another embodiment, an angle α of 45° to 70° may be preferred. And an angle α equal to 65° to 110° may be preferred in yet another embodiment. The preferable ranges for the angle α will vary with other embodiments. Those having ordinary skill in the art will appreciate that the relief region 1101 may be located at other angles not covered by the prior art without departing from the scope of the invention.

Figure 13:
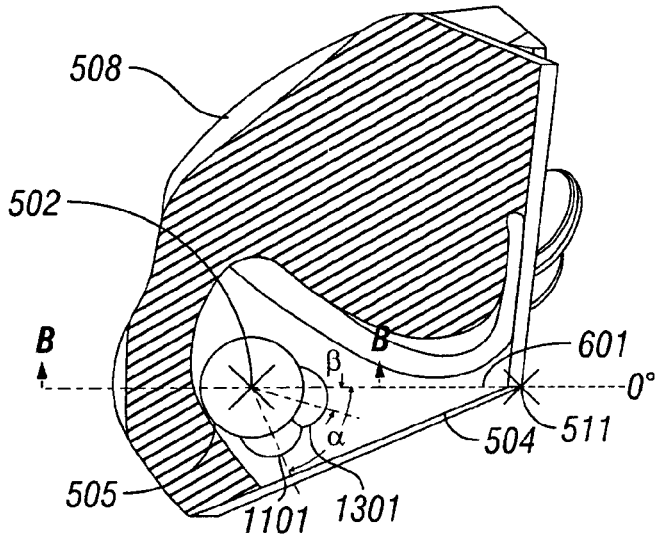
FIG. 13 shows a bottom of a fluid plenum of a leg of a rotary cone bit in accordance with one embodiment of the invention.

In FIG. 13, a cross-section of an embodiment of the present invention is shown. This embodiment of the invention is characterized by two relief regions, 1101 and 1301, formed on the ledge (506 of FIG. 5) at angles α and β, respectively. The angles α and β are selected based on the geometry of the bit body 508. In a particular embodiment, α is set at 65° and β is set at 15°. In another embodiment, α is set at 85° and β is set at 30°. In still another embodiment, α is set at 350° and β is set at 65°. In some embodiments, a first relief region with an angle α between 330° and 30° and a second relief region with an angle β between 30° and 150° may be preferable. Those having ordinary skill in the art will appreciate that the two relief regions, 1101 and 1301, may be located at other angles without departing from the scope of the invention. Additionally, more than two relief regions may be formed without departing from the scope of the invention.

Figure 14:
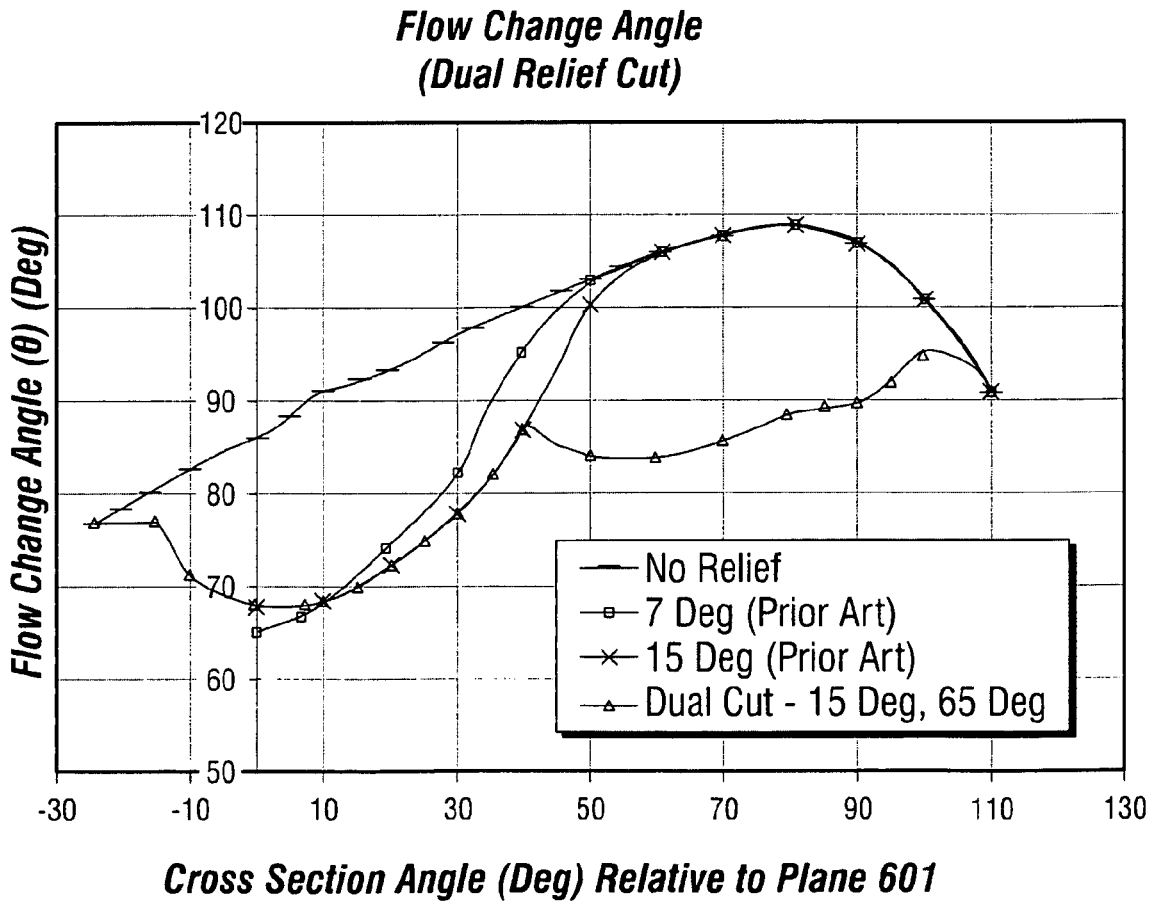
FIG. 14 shows a graph of flow change angles versus cross-section angles in accordance with one embodiment of the invention.

FIG. 14 illustrates the reduction in the flow change angle θ in a range of 2-D cross-section angles after the two relief regions, 1101 and 1301, have been located as shown in FIG. 13. Relief region 1101 has been located at an angle α of 65°. Relief region 1301 has been located at an angle θ of 15° The highest flow change angle θ has been further reduced because of the second relief region. FIG. 14 only illustrates the reduction in the flow change angle θ for one embodiment of the invention. The optimal placement for the two relief regions, 1101 and 1301, will vary according to the geometry of the particular embodiment. Additional relief regions could be formed to further reduce the flow change angle θ depending on the particular embodiment.

Figure 15:
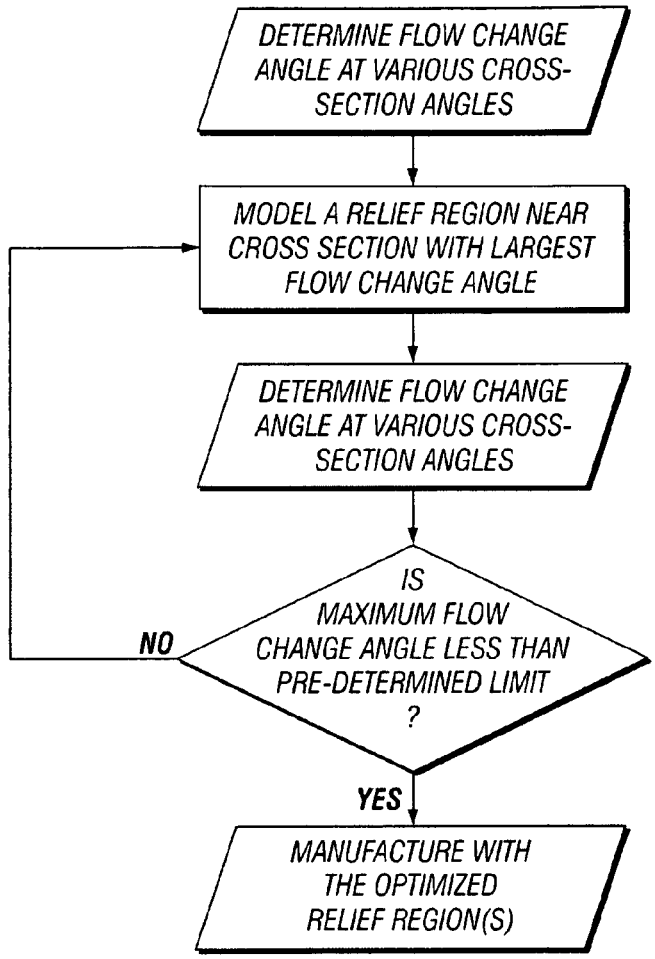
FIG. 15 shows a flowchart of a design method in accordance with one embodiment of the invention.

FIG. 15 is an embodiment of a method to locate at least one relief region to provide improved flow characteristics, over prior art bits. One embodiment of this method determines a flow change angle θ across a range of 2-D cross-sections of a bit body rotated about a fluid orifice. The flow change angles are compared for the purpose of determining an optimal location to form a first relief region. In one embodiment, the flow change angles are determined by using a three-dimensional computer aided drafting ("CAD") model of the bit body. The first relief region is located at an angle α relative to the datum plane. The angle α is selected to be near the location of a maximum flow change angle θ. The relief region (e.g, 1101 in FIG. 11) is then modeled in the CAD model and the flow change angle θ is determined at a range of cross-section angles relative to the datum plane 601 shown in FIG. 6. A second relief region, if the flow change angles have not been sufficiently reduced, is located at an angle β relative to the datum plane, which is determined by the location of the maximum flow change angle θ after the first relief region has been modeled. Those having ordinary skill in the art will appreciate that a single relief region or more than two relief regions may be located by this method without departing from the scope of the invention.

The method for locating relief regions provides an efficient manner to improve flow through the bit body. Examining the flow change angle θ allows improvement of flow through a bit body with minimal analysis and manufacturing iterations. Those having ordinary skill in the art will be able to use this method to locate additional relief regions without departing from the scope of the invention. Additionally, those having ordinary skill in the art will be able to devise other methods for modeling relief regions in a bit body without departing from the scope of the invention.

After modeling the relief regions, computational fluid dynamics ("CFD") analysis (or other fluid modeling techniques) may be performed on the bit body to verify the fluid flow characteristics. The CFD model demonstrates that fluid separation is reduced where the fluid enters the fluid orifice 505 from the bottom of the fluid plenum 504. The required iterations of CFD analysis to improve fluid flow, which may be very time consuming, are advantageously reduced by applying an embodiment of a method of the invention to model relief regions based on the flow change angle θ.

In another embodiment, a prior art bit body has been previously manufactured with a single relief region between an angle α of 7° and 15°. The fluid flow through the bit body is improved by forming a second relief region at an angle β greater than 15 degrees relative to the plane . The result is similar to FIG. 13. In one embodiment, the second relief region is formed using the drill inserted through the fluid orifice from the bottom of the bit body. In another embodiment, the second relief region is formed using the drill inserted through the fluid plenum. Those having ordinary skill in the art will be able to utilize other rotary machining tools capable of making relief regions of various form without departing from the scope of the invention.

Figure 16:
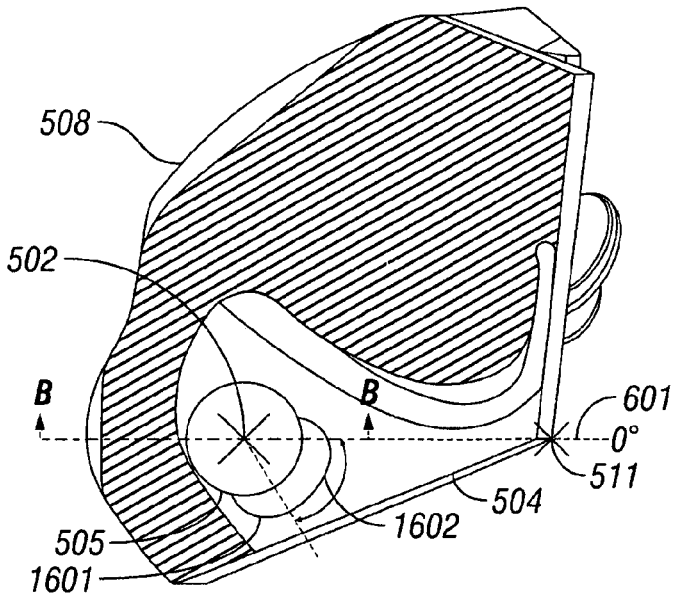
FIG. 16 shows a bottom of a fluid plenum of a leg of a rotary cone bit in accordance with one embodiment of the invention.

FIG. 16 illustrates another embodiment of the invention. A swept relief region 1601 is formed by continuously sweeping a mill, not shown, across the ledge 506. The swept relief region 1601 is characterized by having an outer arcuate section 1602 that is substantially concentric to the fluid orifice axis 502. The mill may be inserted through the fluid plenum or the fluid orifice 505 to form the swept relief region 1601. In this particular embodiment, the swept relief region has been located substantially towards the bit body axis 511 to aid fluid flow from the fluid plenum 503 into the fluid orifice 505. The fluid plenum geometry of a particular embodiment may alter the preferred location for the swept relief region. One of ordinary skill in the art will appreciate that the swept relief region 1601 may be formed by other rotary machining tools or any other means known in the art without departing from the scope of the invention. Additionally, the arcuate section may be non-concentric with the fluid orifice without departing from the scope of the invention.

Figure 17:
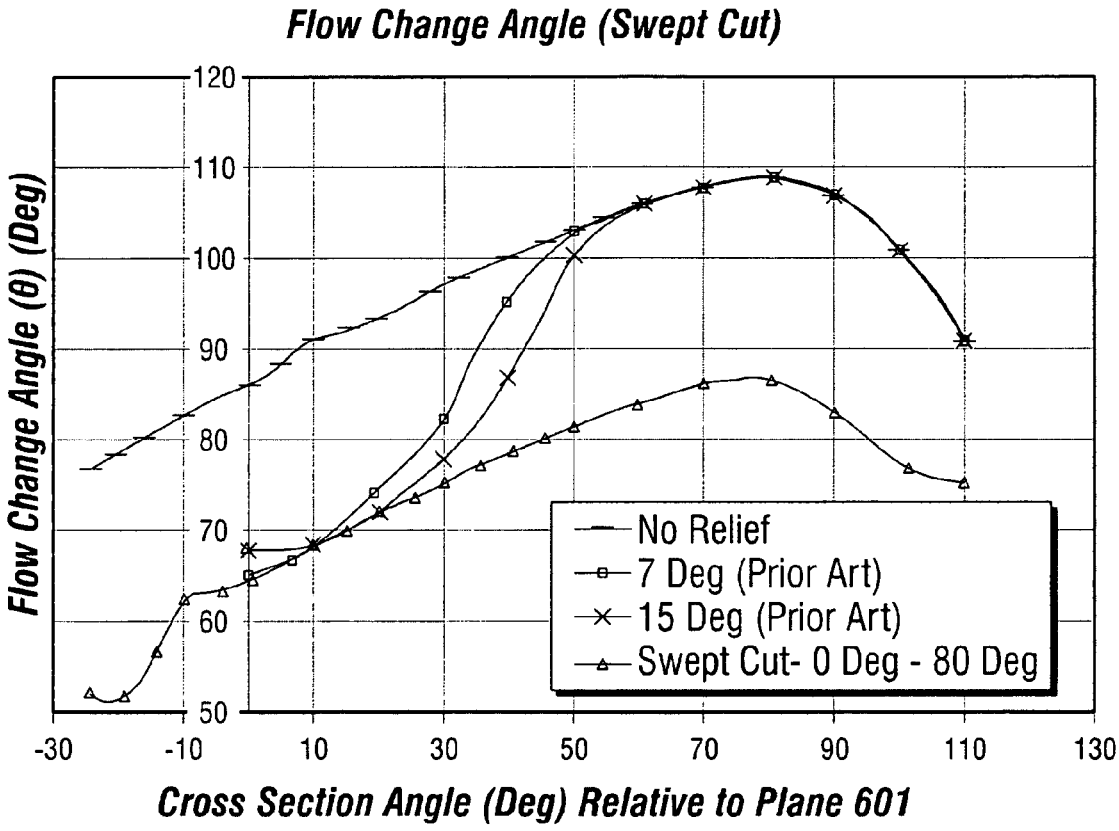
FIG. 17 shows a graph of flow change angles versus cross-section angles in accordance with one embodiment of the invention.

FIG. 17 illustrates the reduction in the flow change angle θ in a range of 2-D cross-section angles after the swept relief region 1601 has been located as shown in FIG. 16. The swept relief region 1601 has been formed with the outer arcuate section 1602 having a span of about 80°. FIG. 17 only illustrates the reduction in the flow change angle θ for one embodiment of the invention. The optimal placement for the swept relief regions 1601 will vary according to the geometry of the particular embodiment. For example, the geometry of the bit may restrict the span of the outer arcuate section 1602 of the swept relief region 1601. For example, the swept relief region 1601 may be restricted to having an outer arcuate section 1602 with a span of only 60°. One of ordinary skill in the art will appreciate that the actual span of the arcuate section 1602 and the orientation of the swept relief region 1601 may vary without departing from the scope of the invention.

The effect of forming relief regions has been examined through the use of CFD. FIGS. 18-21 are images from CFD analysis run on a 9-⅞" roller-cone drill bit. The flow rate through the bit is the same for each of the FIGS. 18-21. As mentioned previously, fluid enters the bit body at the inlet and continues into the fluid plenum. Fluid is forced against the bottom of fluid plenum 504 until it reaches the ledge 506 formed between the bottom of fluid plenum 504 and fluid orifice 505. The images in FIGS. 18-21 are of the 2-D cross-section 602 at an angle Γ of 80°. Each of the images are focused on a fluid orifice 505 so that they display the critical fluid flow past the ledge 506 and into the fluid orifice 505. Arrows in the images represent fluid flow. The size of the arrowheads and the length of the tails is proportional to the velocity of the fluid. The arrowheads point in the direction of the fluid flow. The lack of an arrowhead on a line in the images indicates that the particular portion of fluid flow lacks uniform direction. This typically occurs when fluid separates and recirculates in a swirling fashion.

Figure 18:
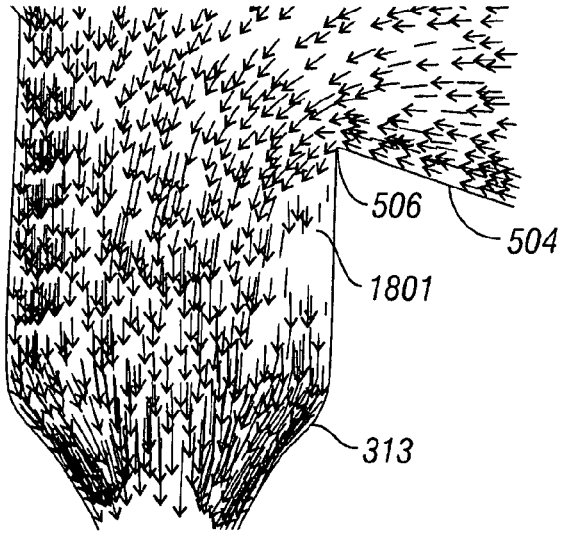
FIG. 18 (Prior Art)
FIG. 18 is an image from a computational fluid dynamics analysis performed on a prior art bit body.

FIG. 18 is the CFD analysis of the 9-⅞" bit with a single relief region formed at an angle α of 15°, as in the prior art. A portion of the fluid flows along the bottom of fluid plenum 504. As the fluid reaches ledge 506, it turns sharply to enter into fluid orifice 505. As the fluid turns, it separates and forms a recirculation zone 1801. The fluid swirls in recirculation zone 1801 until it exits bit body 508 through nozzle 313. Recirculation is largely responsible for erosion inside of the drill bit. The rate of erosion will vary depending largely on the flow rate, abrasives contained in the fluid, and the amount of recirculation.

Figure 19:
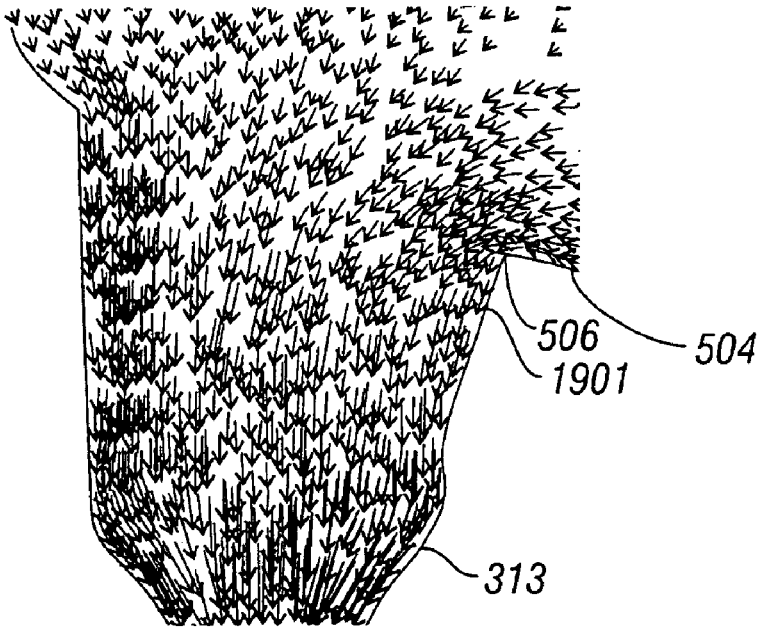
FIG. 19 is an image from a computational fluid dynamics analysis performed on a bit body in accordance with one embodiment of the invention.

FIG. 19 is the CFD analysis of the same 9-⅞" bit used in FIG. 18. However, a single relief region has been formed at an angle α of 65° in accordance with an embodiment of the present invention. The location of the relief region at 65° reduced the flow change angle θ at the angle Γ of 80° as shown in FIG. 18. A recirculation zone 1901 still exists, but is much smaller than the recirculation zone 1801 of FIG. 18. The recirculation zone 1901 is sufficiently small, so as to typically not cause enough erosion to be of concern.

Figure 20:
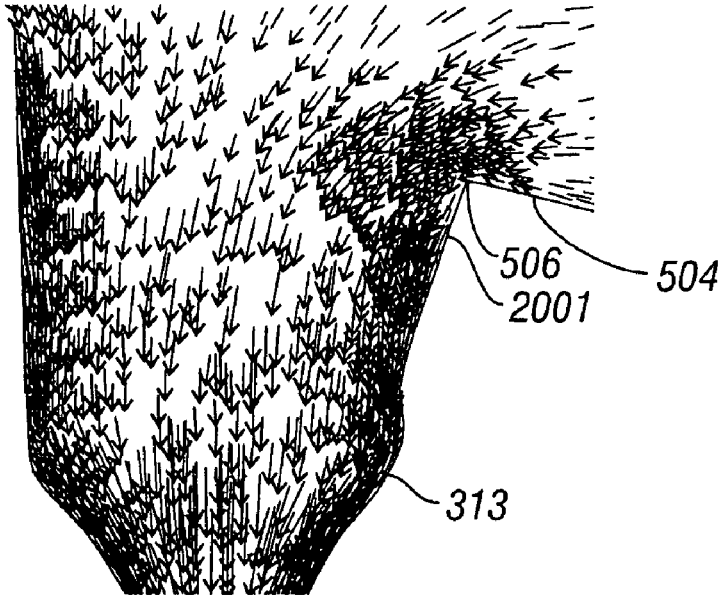
FIG. 20 is an image from a computational fluid dynamics analysis performed on a bit body in accordance with one embodiment of the invention.

FIG. 20 is the CFD analysis of the same 9-⅞" bit used in FIG. 18. However, two relief regions have been formed at an angle α of 65° and an angle β of 15° in accordance with an embodiment of the present invention. The result is similar to that shown in FIG. 19, but a recirculation zone 2001 is further reduced compared to the recirculation zone 1901.

Figure 21:
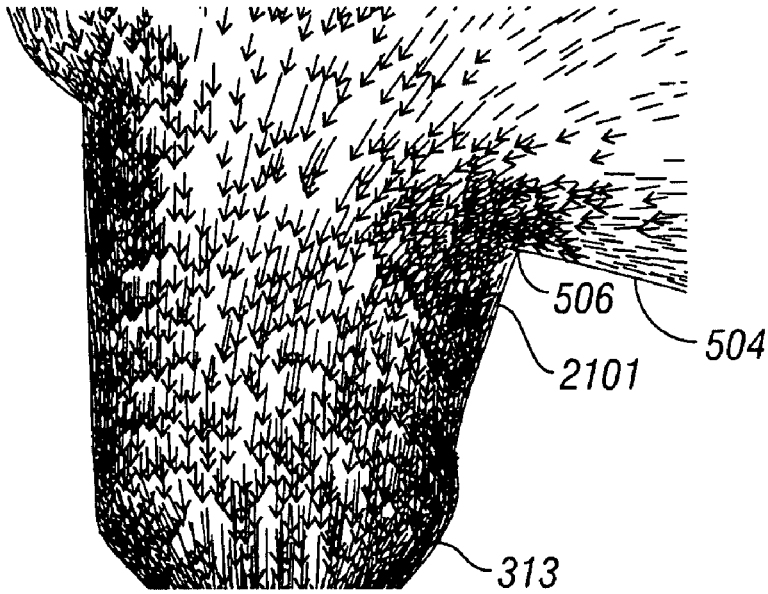
FIG. 21 is an image from a computational fluid dynamics analysis performed on a bit body in accordance with one embodiment of the invention.

FIG. 21 is the CFD analysis of the same 9-⅞" bit used in FIG. 18. However, a swept relief region has been formed with an arcuate section having a span of about 80° in accordance with an embodiment of the present invention. The swept relief region in this example was formed such that the arcuate section begins from the datum plane. The swept relief region results in a recirculation zone 2101 which is further reduced in size compared to recirculation zones 1901 and 2001.

Based on the CFD analysis performed on the 9-⅞" bit and actual use of the 9-⅞" bit, it has been found that reducing the flow change angle θ below about 95° is typically sufficient to reduce recirculation of drilling fluid. For lower flow rates, a higher flow change angle θ may be acceptable. Higher flow rates may require the flow change angle θ to be further reduced. One of ordinary skill in the art will appreciate that the desired value of the flow change angle θ may be higher or lower without departing from the scope of the invention.

Another aspect of the present invention is the reduction of the fluid velocity at the fluid orifice entrance as the fluid enters into the fluid orifice from the fluid plenum. The forming of at least one relief region on the ledge formed between the bottom of the fluid plenum and the fluid orifice results in an increase in the fluid orifice entrance area. This results in a lower fluid velocity for a given flow rate. The lower fluid velocity results in reduced rate of erosion. This effect is due to lowering the velocity of abrasive particles typically contained in the fluid. As is known in the art, a reduction of velocity results in a reduction of the energy in each abrasive particle. The abrasive particles remove less material from the bit body as a result of their reduced energy.

The overall reduction in the average fluid velocity at the fluid orifice entrance is proportional to the increase in the fluid orifice entrance area. The actual reduction in the fluid velocity may vary across the flow area. CFD, or other suitable means, may be used to help determine the actual reduction of the fluid velocity at different points across the fluid orifice entrance.

An average reduction of the fluid velocity may be estimated by determining the increase in the fluid orifice entrance area resulting from the forming of relief regions. A comparison of the prior art FIG. 6 with some embodiments of the present invention illustrated in FIGS. 11, 13, and 16 aids in determining the increase in the fluid orifice entrance area. FIGS. 6, 11, 13, and 16 are oriented normal to fluid orifice 502. FIG. 6 does not contain a relief region. FIGS. 11, 13, and 16 contain one relief region, two relief regions, and one swept relief region respectively. Comparing each of these embodiments illustrates the increase in the fluid orifice entrance area. The fluid orifice entrance area may be determined using a CAD model of the bit body 508, scanning equipment on an actual bit body, or any other suitable means known in the art.

Figure 22:
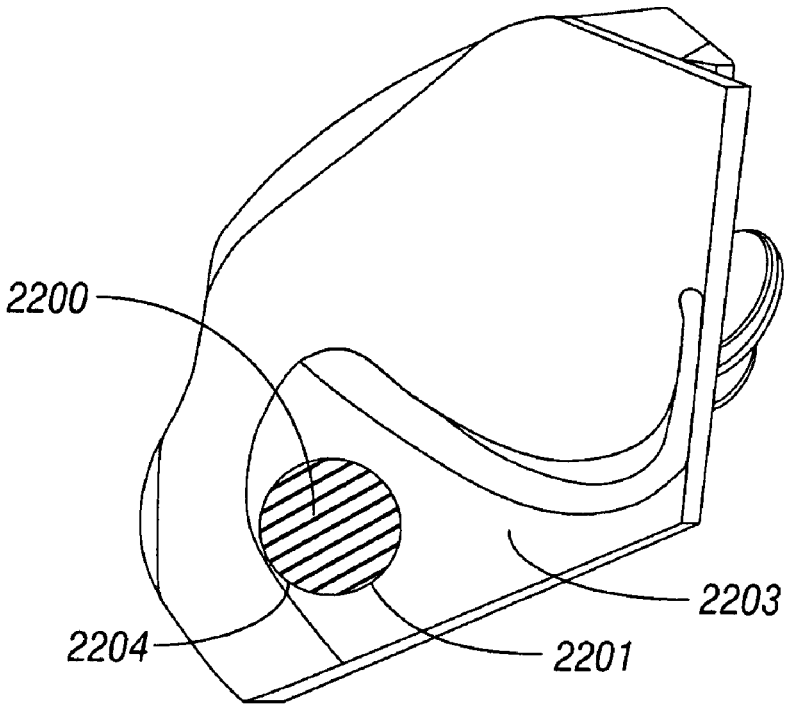
FIG. 22 shows a bottom of a fluid plenum of a leg of a prior art rotary cone bit.
Figure 23:
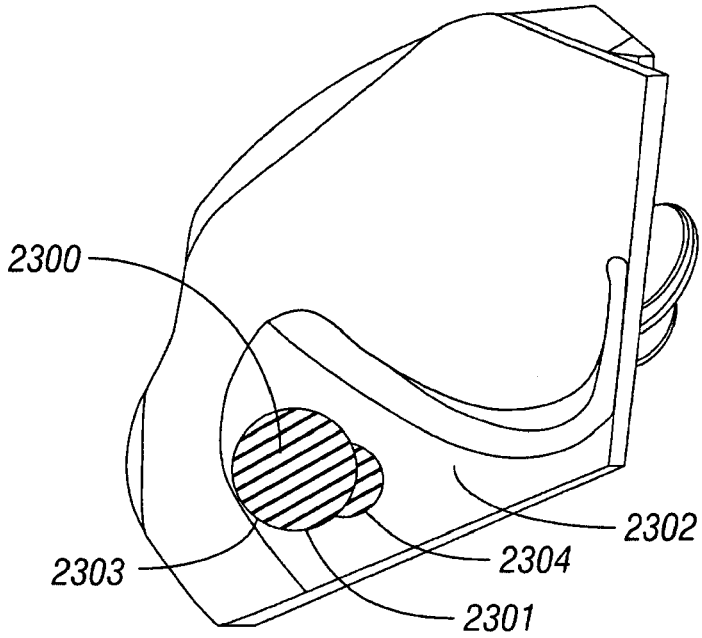
FIG. 23 shows a bottom of a fluid plenum of a leg of a rotary cone bit in accordance with one embodiment of the invention.

FIGS. 22 and 23 illustrate one means of determining the fluid orifice entrance area using a CAD model of the bit body. FIG. 22 shows a nozzle orifice entrance with no relief region. The view is oriented normal to the nozzle orifice bore axis. The projected entrance area is shown by the cross hatching 2200. The bounds of the entrance area are defined by ledge 2201 created at the intersection of the fluid plenum 2203 and the fluid orifice 2204. FIG. 23 shows fluid orifice 2303 with a relief region 2304 in a view that is oriented normal to the nozzle orifice axis (2401 of FIG. 24) and shows the fluid orifice entrance area 2300 in cross-hatching. The entrance area is bounded by ledge 2301 that is created by the intersection of fluid orifice 2303 and fluid plenum 2302.

Figure 24:
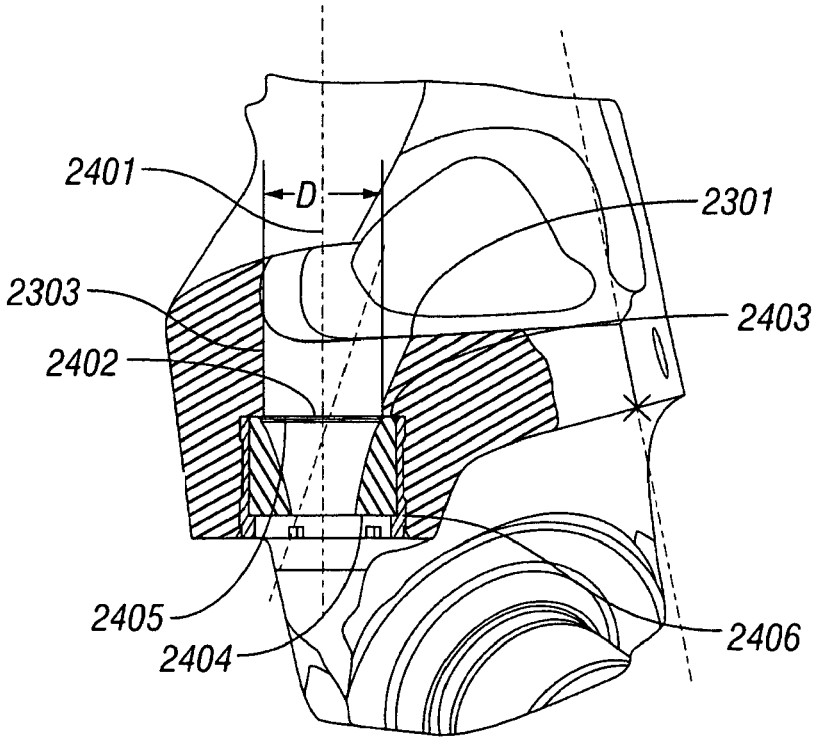
FIG. 24 shows a cross-section of a leg of a rotary cone bit in accordance with one embodiment of the invention.

FIG. 24 illustrates the nozzle entrance area, which may be compared to the fluid orifice entrance area to determine the increase in the fluid orifice entrance area. The nozzle entrance area 2402 is the area of the fluid orifice 2303 adjacent to the nozzle seat 2403. Usually the nozzle entrance area 2402 will have a diameter "D" that is about the same as the entrance diameter 2405 of the nozzle 2404. While the nozzle entrance area is generally circular, it may also have other shapes to condition the flow for entrance into the nozzle. The nozzle is held against the nozzle seat by retainer 2406. While nozzle retainer 2406 is threaded in this embodiment, snap ring retention, nail retention, or other means of retaining the nozzle may be used without departing from the scope of the invention.

Prior art fluid orifices with single relief regions have fluid entrance areas that are larger than the nozzle entrance area by about 16 percent or less. However, in many embodiments, it is preferable to have a fluid orifice entrance area that is 20 percent larger than the nozzle entrance area. It may be more preferable to have a fluid orifice entrance area that is about 30 percent or larger than a nozzle orifice entrance area without a relief cut. It may be even more preferable to have an entrance area that is about 40 percent or larger than nozzle entrance area. Thus, another embodiment of the current invention, includes the use of a single relief region as shown in FIG. 9, but with an orifice entrance area that is at least 20 percent larger than the nozzle entrance area.

Once the fluid orifice entrance area and nozzle entrance area have been determined, the two values may be compared. For example, a fluid orifice with a nozzle entrance diameter of about 1.06 inches has an approximate nozzle entrance area of 0.88 $in^2$. Forming one relief region similar to the relief region shown in FIGS. 7 and 8 results in a fluid orifice entrance area of approximately 1.02 $in^2$. This represents about a 16 percent increase in the fluid orifice entrance area. Forming a single relief region at a larger angle $\gamma$ could result in an increase of the fluid orifice entrance area of 20 percent. Forming two relief regions similar to those shown in FIG. 13 may result in a fluid orifice entrance area of approximately 1.14 $in^2$. This represents about a 30 percent increase in the fluid orifice entrance area. Forming a swept relief region similar to that shown in FIG. 16 may result in a fluid orifice entrance area of approximately 1.25 $in^2$. This represents about a 42 percent increase in the fluid orifice entrance area when compared to the original cross-sectional area of the fluid orifice. The actual decrease in the fluid velocity at the fluid orifice entrance may be nearly proportional to the increase in the fluid orifice entrance area. One of ordinary skill in the art will appreciate that forming larger, smaller, or additional relief regions may affect the fluid orifice entrance area without departing from the scope of the present invention.

As discussed in the Background section, the fluid accelerates as it flows into the fluid orifice from the fluid plenum. This rapid acceleration occurs where the fluid flows across the ledge formed between the bottom of the fluid plenum and the fluid orifice. The sudden change in direction of the fluid combined with the increased fluid velocity contributes to the occurrence of fluid separation. Increasing the fluid orifice entrance area causes the fluid velocity to be lower in this important area. A reduced fluid velocity assists in reducing the amount of separation of the fluid as it flows across the ledge formed between the bottom of the fluid plenum and the fluid orifice to enter into the fluid orifice. Additionally, it reduces the velocity of any small recirculation zones the may still exist, greatly reducing the kinetic energy of the recirculation zone. The reduction in fluid separation may vary in different embodiments. The geometry of the particular bit body, fluid properties, flow rate, and other factors may result in varying reductions in fluid separation.

While the above discussion has demonstrated relief regions that have been formed as drilled or milled straight with a semi-circle or conic profile, the scope of the invention is not limited to these forms of relief regions. The relief regions may be formed with various shapes. A rotary machining tool of a desired shape may be utilized to form a relief region in accordance with the present invention. In one embodiment of the invention, the relief region is formed with a chamfer cutter that forms two steps such that the flow change angle $\theta$ is further reduced. In another embodiment of the invention, a swept relief region is formed with an elliptical profile by an elliptically shaped end mill. In another embodiment, a ball end mill of a desired radius is used to form the relief region with a round profile. One of ordinary skill in the art will appreciate that relief regions may be formed in other profiles by rotary machining tools to reduce the flow change angle $\theta$ without departing from the scope of the invention. Additionally, one of ordinary skill in the art will appreciate that the relief region may be formed by any other manufacturing method known in the art without departing from the scope of the invention.

Embodiments of the present invention may provide one or more of the following advantages. Locating relief regions to reduce the flow change angle $\theta$, thereby reduces separation of the fluid as it enters the fluid orifice from the fluid plenum. Separation of the fluid results in recirculation of the fluid, which commonly includes harsh abrasives that erode the bit body. The resulting erosion may eventually lead to a washout of the bit body. A washout requires pulling the drill string out of the wellbore and replacing the drill bit at a great expense of time and money. By reducing fluid separation, the disclosed invention advantageously reduces the occurrence of washouts.

Moreover, reduction in the flow change angle $\theta$ advantageously allows for less energy loss by reducing fluid separation. The energy that erodes the bit body, causing the washout is provided by surface equipment. When fluid separates in a flow stream, pressure is lost. The surface equipment must provide the pressure to overcome those losses. Surface equipment is limited in the pressure that it may provide. Reducing these pressure losses advantageously allows for a higher flow rate at a lower pressure. The higher flow rate may provide more effective removal of cuttings.

With regard to fixed cutter applications, PDC drill bits may be generally characterized into two categories, matrix body bits and steel body bits. Matrix body bits are manufactured using a mold to form matrix powder into a desired bit body shape. Once the matrix powder is poured into the mold with a binder, the mold is placed in a furnace where the binder melts and infiltrates the matrix powder in a process called sintering. Once cooled, the sintered bit body is removed from the mold, and the remainder of the components of the drill bit are assembled. In contrast, the cutting heads of steel body bits are machined from solid pieces of metal. While these bits are commonly referred to as "steel" bits, it should be understood that any material suitable for cutter body construction may be used. Once machined, the cutting head is attached to a bit shank and the remainder of the steel body bit may be assembled.

Figure 25:
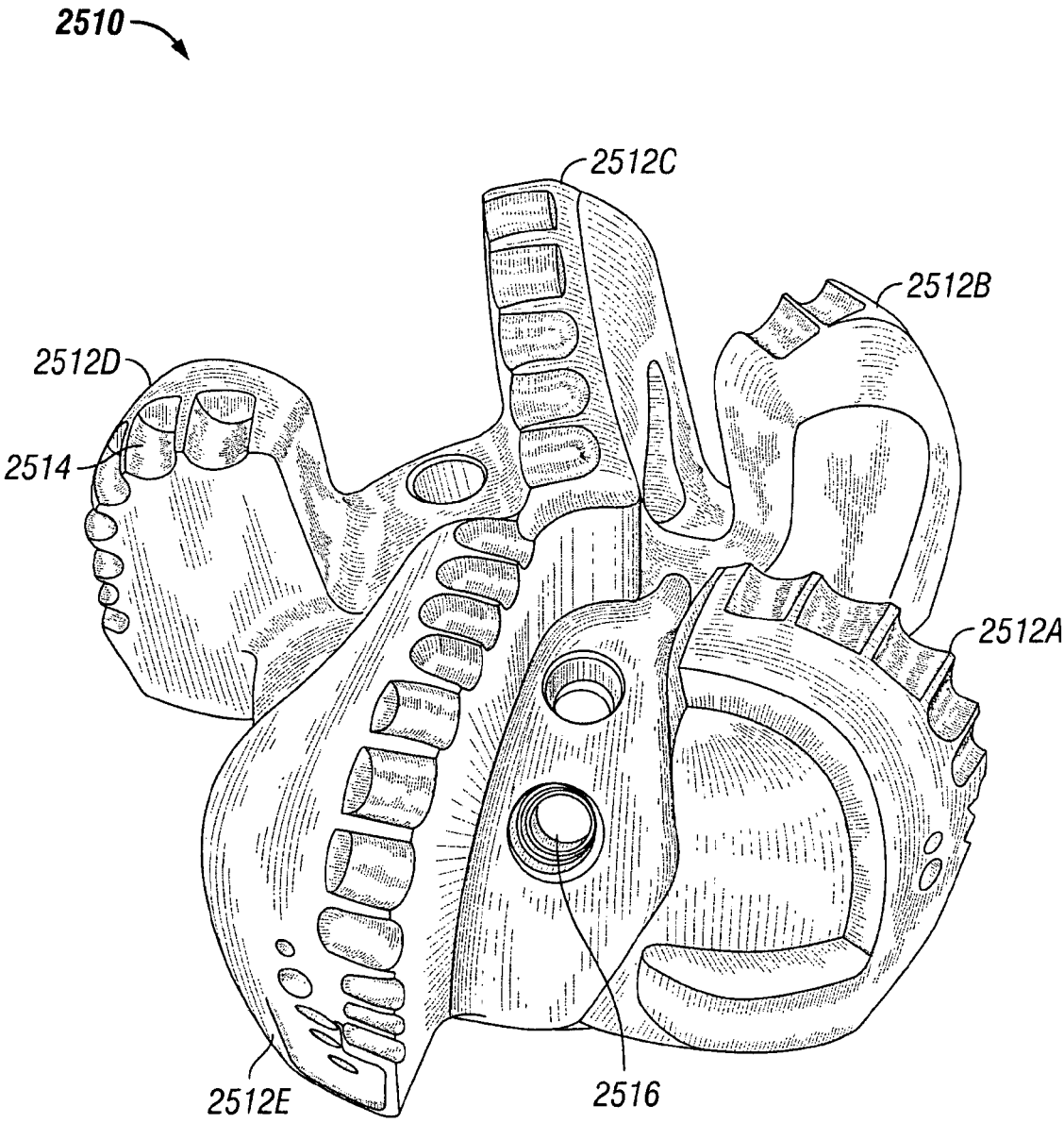
FIG. 25 is an image of the upper portion of a steel body PDC bit.
Figure 26:
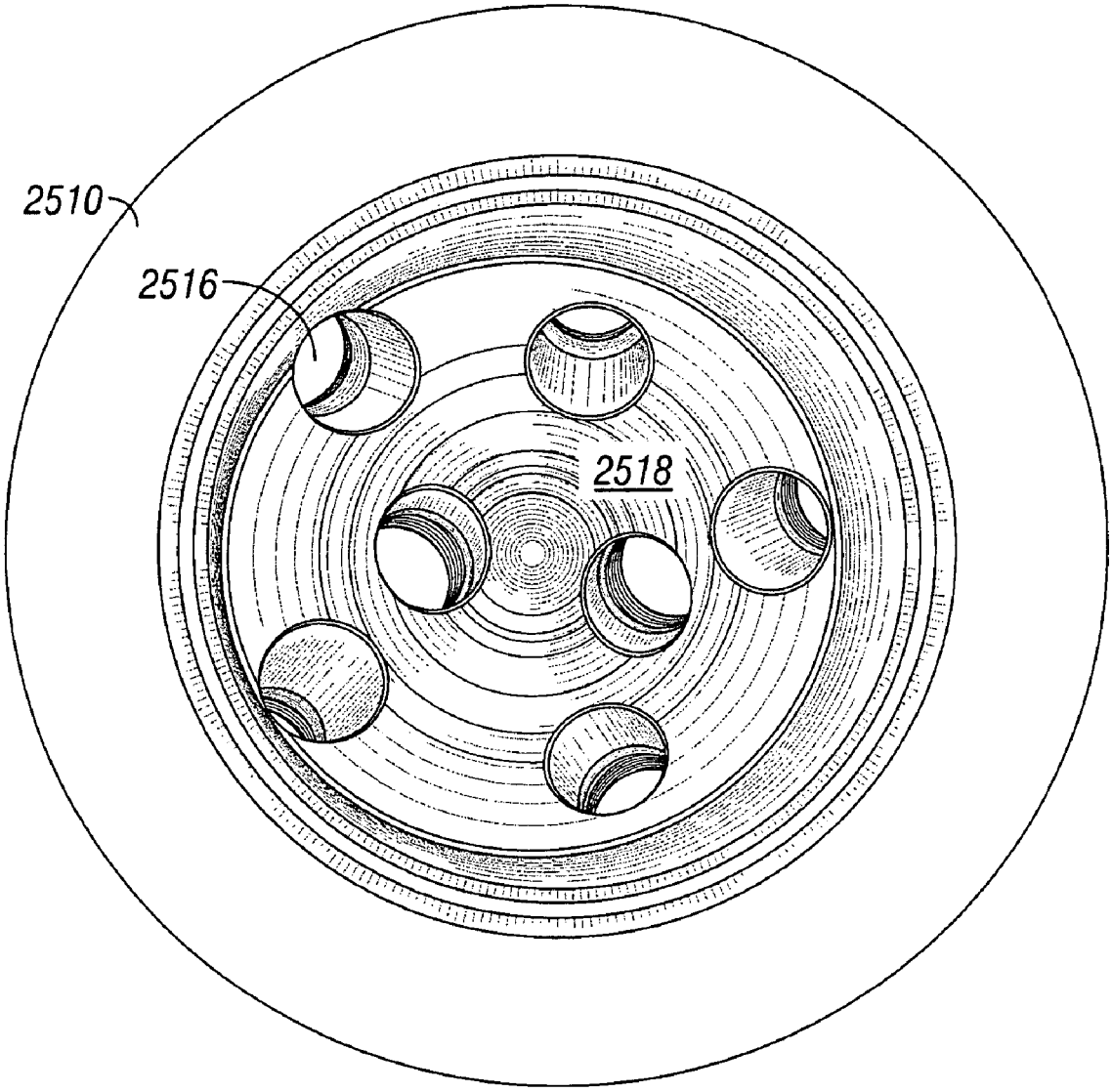
FIG. 26 is an image of the internal hydraulics of the steel body PDC bit of FIG. 25.

An example of a machined steel cutting head may be seen in FIGS. 25 and 26. Particularly, FIG. 25 is a top-view drawing of a machined steel cutting head 2510. Cutting head 2510 is shown as having 5 cutter blades 2512A-E, wherein each cutter blade 2512 includes machined receptacles 2514 configured to receive cutter elements (not shown). Furthermore, a plurality of bores 2516 configured to receive fluid nozzles are located between cutter blades 2512. Referring briefly to FIG. 26, the underside of cutting head 2510 is visible such that the ends of bores 2516 terminating in a fluid plenum 2518 are visible. To complete assembly, the underside of cutting head 2510 is mechanically attached (e.g welded, brazed, etc.) to a bit shank including a flow bore and a drillstring connection and cutting elements (not shown) are similarly mechanically secured within receptacles (2514 of FIG. 25). Finally, fluid nozzle assemblies (not shown) are secured within bores 2516 and direct the drilling fluid to desired locations for cleaning the drill bit while drilling.

Referring now to FIGS. 27-32, contour plots detailing the flow of fluids through bits in accordance with embodiments of the present invention are shown. In each Figure, lighter regions represent regions of higher fluid velocity than darker regions. Therefore, fluid separation in fluid passageways is evidenced by slower darker flow regions and lighter regions represent more optimized flow. The darker regions experiencing flow separation are at a much higher risk of premature wear and erosion from that flow than lighter regions. Armed with data from such fluid velocity models, designers may alter the geometries of fluid passageways and plenums within drill bits to reduce flow separation regions and increase bit longevity.

Figure 27:
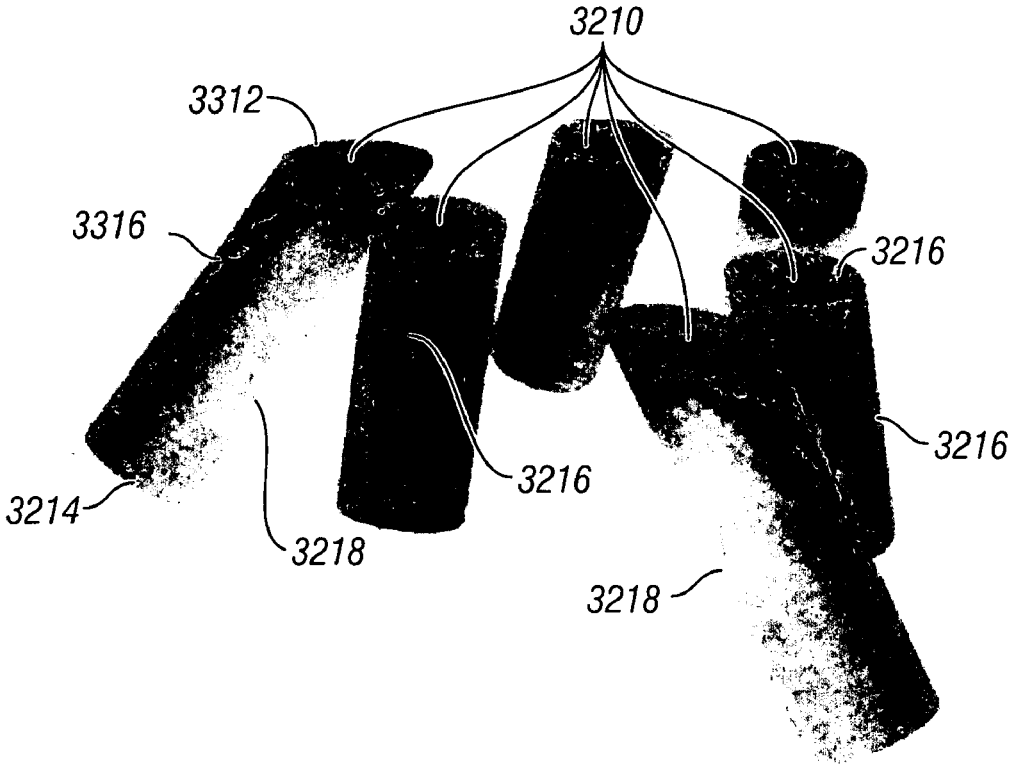
FIG. 27 shows a velocity contour plot of PDC nozzle bores where no radii exist at their intersections with a fluid plenum.

Referring now to FIG. 27, a velocity contour plot for a plurality of non-radiused flow passages 3210 of a drill bit is shown. In each flow passage 3210, fluid flows from a plenum (not shown), through an upper portion 3212 of flow passage 3210, and out a lower portion 3214 of the flow passage. Dark areas 3216 of contour plot represent separated low-velocity fluid flow and lighter areas 3218 represent faster non-separated regions. Because several flow passages 3210 display significant darker areas 3216, the configuration of flow passages 3210 should be optimized to decrease erosion and increase the life of the bit.

Figure 28:
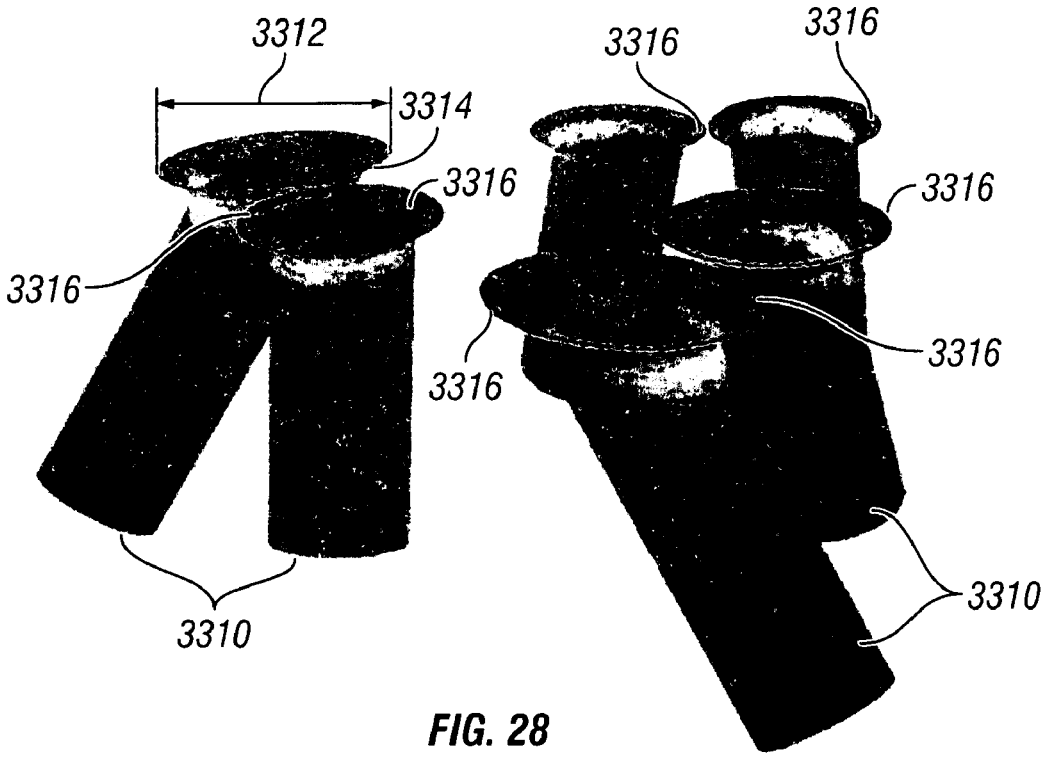
FIG. 28 shows a velocity contour plot of PDC nozzle bores where radii exist at their intersections with a fluid plenum in accordance with an embodiment of the invention.

Referring now to FIG. 28, radiused flow passages 3310 are shown. Improved flow passages 3310 include radiused relief regions 3312 at their intersection with fluid plenum (not shown) inside the drill bit. As discussed above, various configurations for relief regions may be modeled to determine the optimal configuration for a particular bit. Referring to flow passages 3310, relief regions 3312 are constructed as radiused regions swept 360° around upper portions 3314 of flow passages 3310. In comparison to the contour plots of FIG. 27, the contour plots of FIG. 28 disclose only isolated areas of flow separation 3316 that are much smaller than areas 3216 of FIG. 27. Referring now to FIG. 29, a cross-sectional comparison of a radiused passage 3410 with a non-radiused passage 3412 is shown. As can be seen in the drawing, the radiused passage 3410 has a significantly lighter center region than its non-radiused counterpart.

Figure 31:
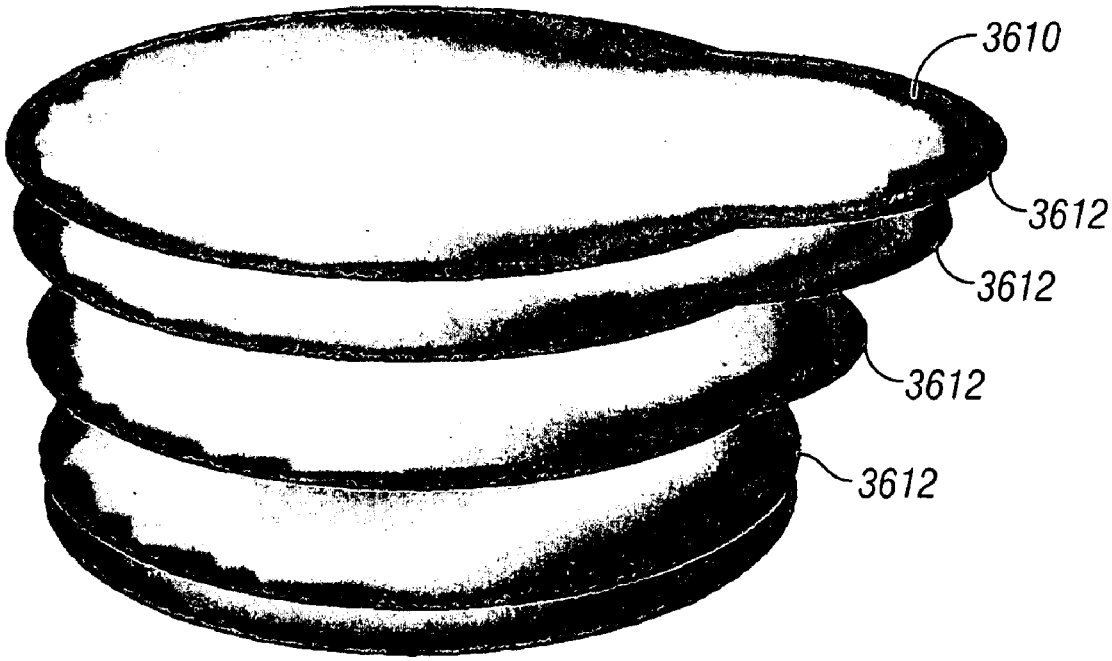
FIG. 31 shows a sectioned velocity contour plot of a PDC nozzle bore having a relief region between the nozzle bore and a fluid plenum in accordance with an embodiment of the invention.
Figure 32:
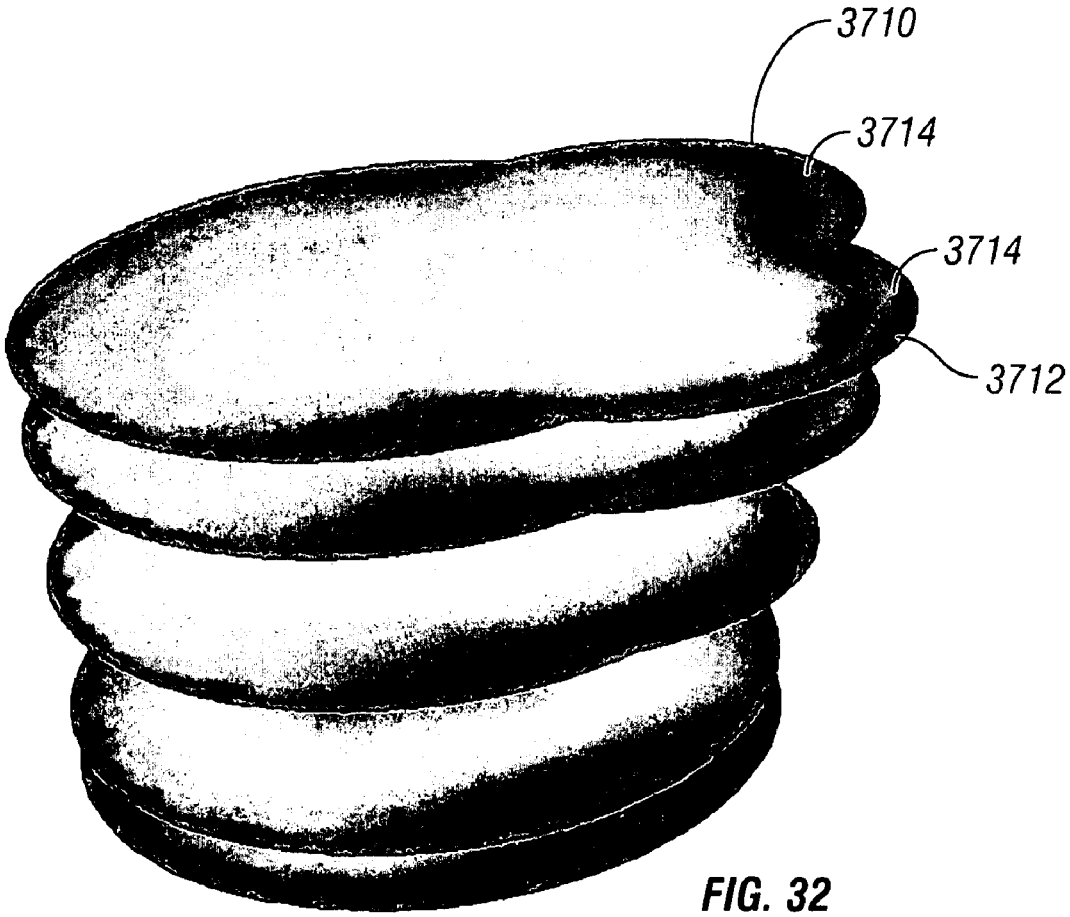
FIG. 32 shows a sectioned velocity contour plot of a PDC nozzle bore having two relief regions between the nozzle bore and a fluid plenum in accordance with an embodiment of the invention.
Figure 33:
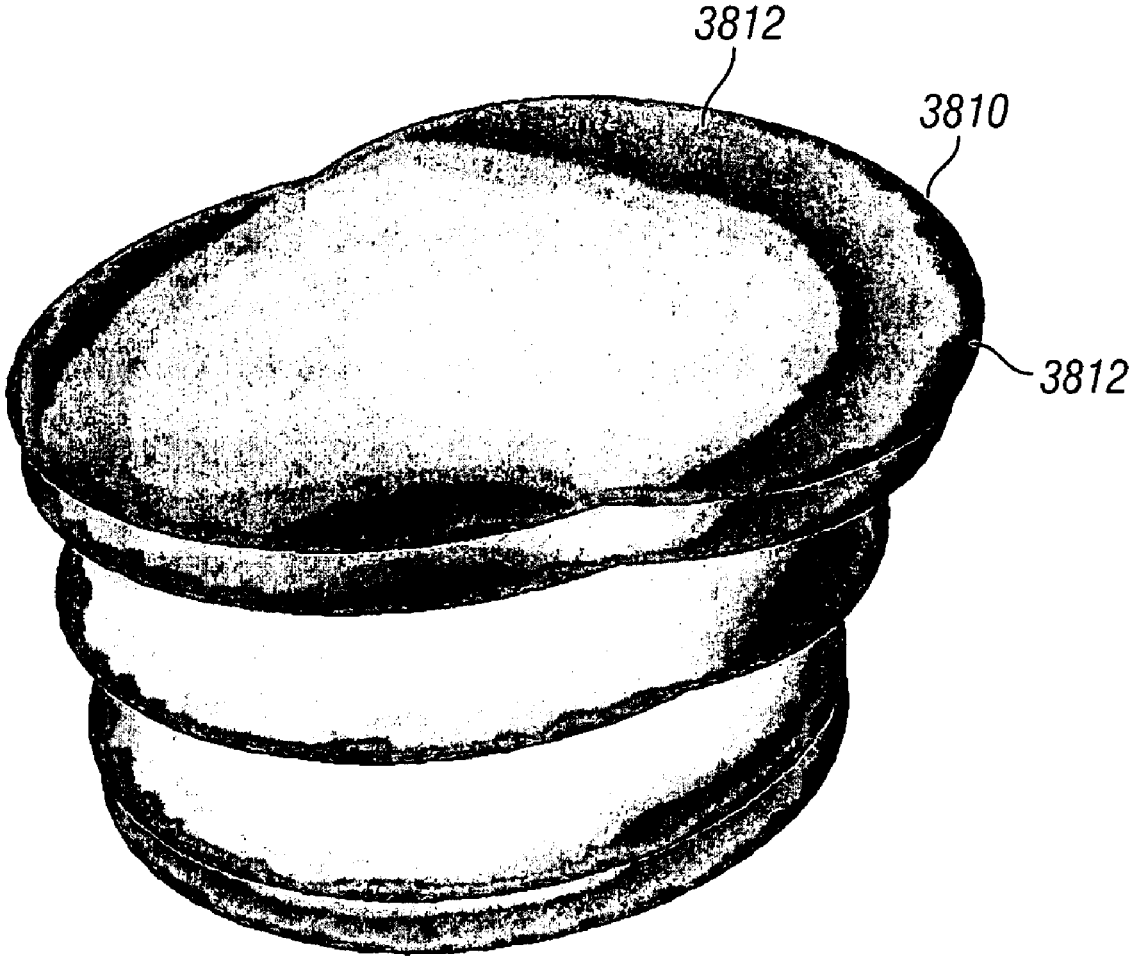
FIG. 33 shows a sectioned velocity contour plot of a PDC nozzle bore having a swept relief region between the nozzle bore and a fluid plenum in accordance with an embodiment of the invention.

Referring now to FIG. 30, a sectioned velocity profile for an inlet passage without any relief regions is shown. As can be seen in the velocity profile, darker regions 3510 indicate significant flow separation. Referring now to FIG. 31, a sectioned velocity profile for an inlet passage with a single relief region 3610 is shown. As can be seen in the velocity profile, the darker areas 3612 indicating flow separation are significantly reduced when compared to FIG. 30. Referring now to FIG. 32, a sectioned velocity profile for an inlet passage with dual relief regions 3710, 3712 is shown. As can be seen in the velocity profile, the darker areas 3714 corresponding to flow separation zones are significantly reduced in comparison to FIG. 30. Referring finally to FIG. 33, a sectioned velocity profile for an inlet passage with a single swept relief 3810 region is shown. As evidenced by the velocity profile, the darker regions 3812 corresponding to flow separation zones are significantly reduced when compared to those of FIG. 30.

Figure 34:
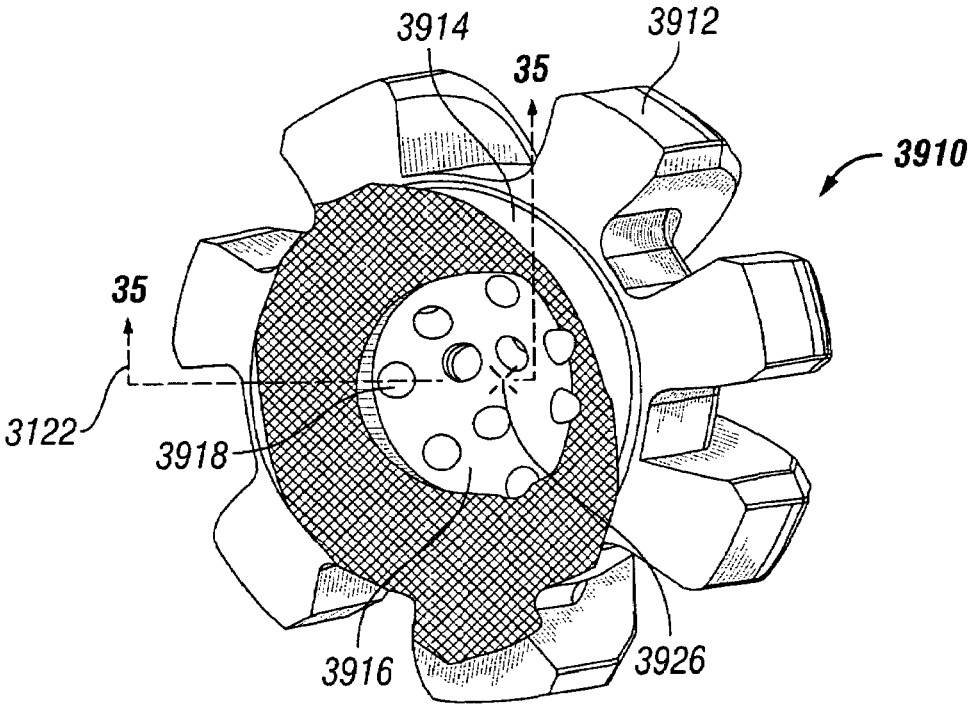
FIG. 34 shows an isometric bottom-view drawing of a fluid plenum of a PDC bit.
Figure 35:
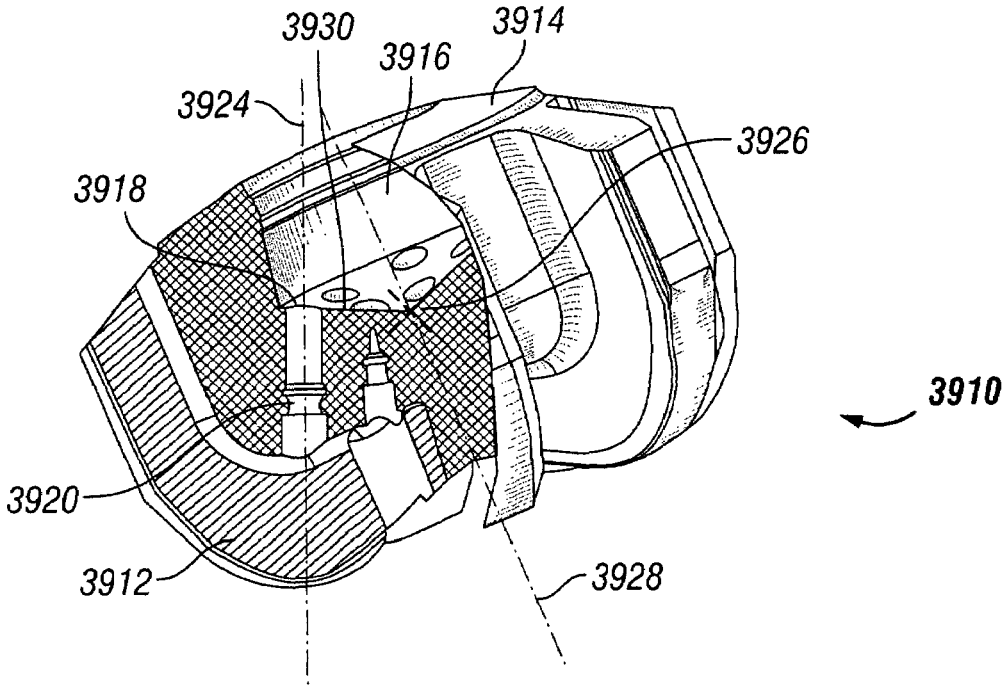
FIG. 35 shows a sectioned side-view drawing of the PDC bit and fluid plenum of FIG. 34.

Referring now to FIGS. 34-43, cross-sectional views of several polycrystalline diamond compact bits manufactured in accordance with embodiments of the present invention are shown. Referring initially to FIGS. 34 and 35, a PDC bit 3910 having 7 cutting blades 3912 is shown in a sectioned view. Furthermore, PDC bit 3910 includes a bit body 3914 having a fluid plenum 3916 in communication with a plurality of fluid orifices 3918 there inside. Typically, each fluid orifice 3918 is in communication with a corresponding nozzle port 3920 inside bit body 3914. Nozzle ports 3920 are used to transmit drilling fluids from the bore of a drillstring (not shown), through fluid plenum 3916, to a plurality of PDC cutter elements (not shown) mounted about the periphery of bit body 3914 and cutting blades 3912.

For each nozzle port 3920, a datum (i.e. reference) plane 3922 exists such that datum plane 3922 is defined by a nozzle axis 3924 and a point 3926, wherein point 3926 is defined by the intersection of the bottom of fluid plenum 3916 with a bit axis 3928. Therefore, FIG. 35 is a cross-sectional view of PDC bit 3910 of FIG. 34 along datum plane 3922 for nozzle port 3920. As can be seen in FIGS. 34 and 35, no relief regions are visible at a flow change ledge 3930 between the bottom of fluid plenum 3916 and fluid orifice 3918.

Figure 36:
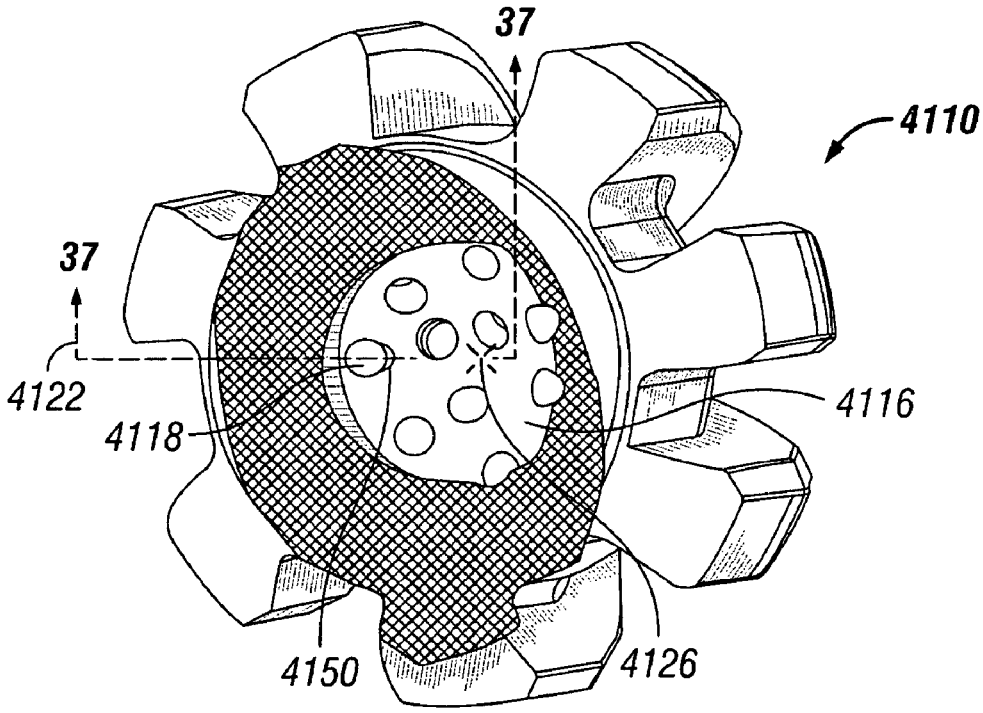
FIG. 36 shows an isometric bottom-view drawing of a fluid plenum of a PDC bit in accordance with an embodiment of the present invention.
Figure 37:
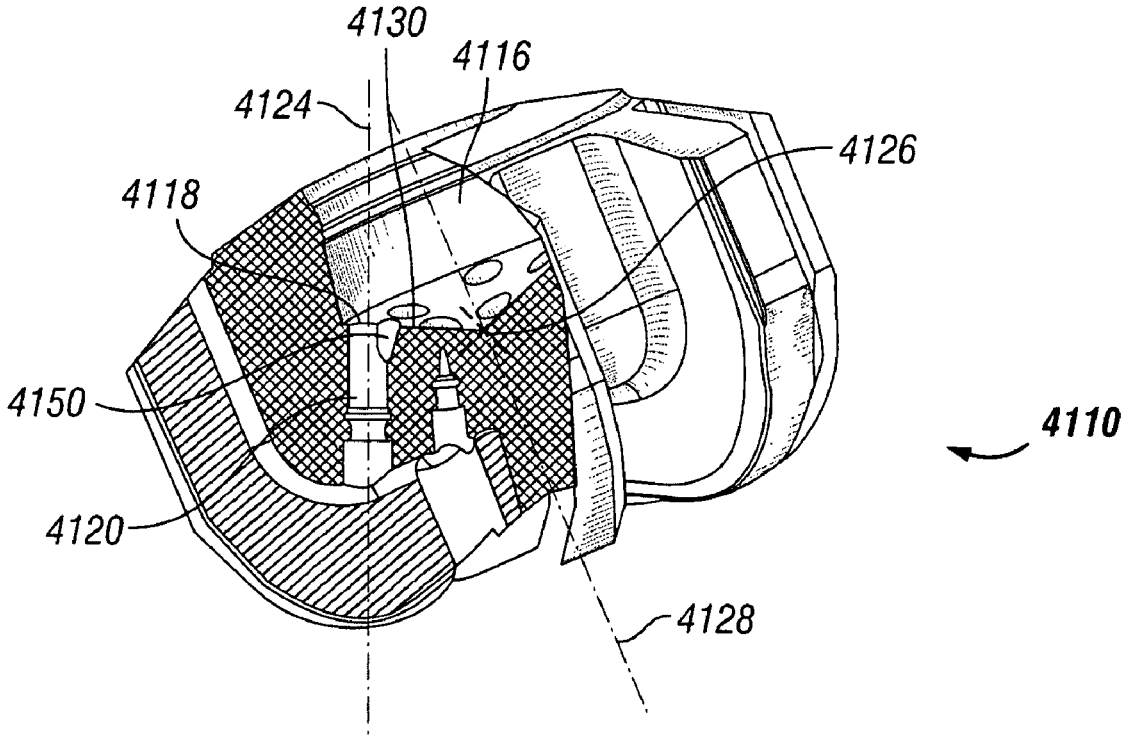
FIG. 37 shows a sectioned side-view drawing of the PDC bit and fluid plenum of FIG. 36.

Referring now to FIGS. 36 and 37, a cross-sectional view of a PDC bit 4110 is shown. Similarly to FIG. 35, FIG. 37 is a cross-sectional view of PDC bit 4110 of FIG. 36 along a datum plane 4122 defined by an axis 4124 of a nozzle port 4120 and a point 4126, wherein point 4126 is defined by the intersection of the bottom of a fluid plenum 4116 with a bit axis 4128. As can be seen in FIGS. 36 and 37, a relief region 4150 is formed at a flow change ledge 4130 between fluid plenum 4116 and a fluid orifice 4118. While relief region 4150 is shown at an angle of 0° relative to datum plane 4122 and nozzle axis 4124, it should be understood that any location angle and size for relief region 4150 can be used, depending on the flow characteristics of a particular PDC bit 4110 to be improved.

Figure 38:
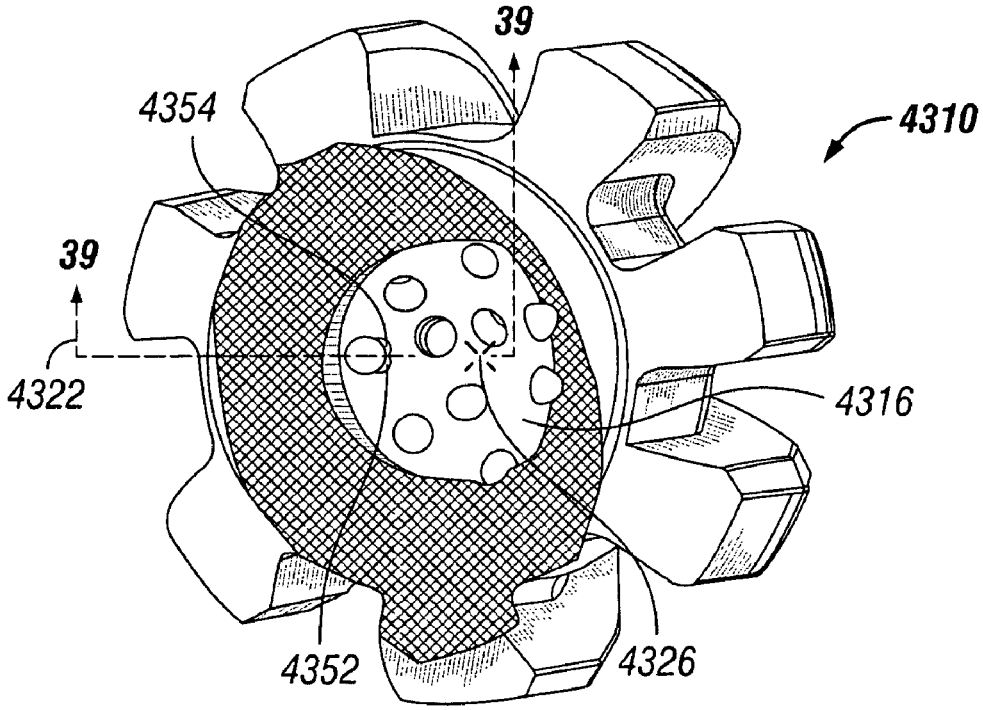
FIG. 38 shows an isometric bottom-view drawing of a fluid plenum of a PDC bit in accordance with an embodiment of the present invention.
Figure 39:
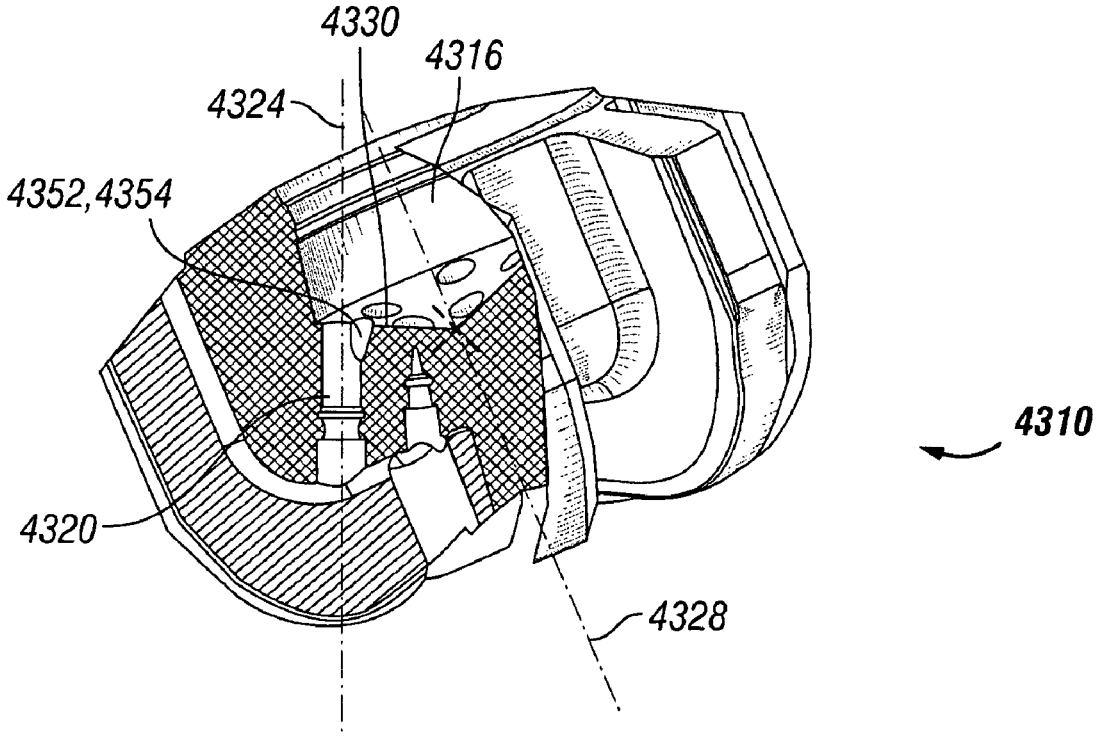
FIG. 39 shows a sectioned side-view drawing of the PDC bit and fluid plenum of FIG. 38.

Referring now to FIGS. 38 and 39, a cross-sectional view of a PDC bit 4310 is shown. Similarly to FIG. 37, FIG. 39 is a cross-sectional view of PDC bit 4310 of FIG. 38 along a datum plane 4322 defined by an axis 4324 of a nozzle port 4320 and a point 4326 defined by the intersection of the bottom of a fluid plenum 4316 with a bit axis 4328. As can be seen in FIGS. 38 and 39, two of relief regions 4352 and 4354 are formed at a flow change ledge 4330 between fluid plenum 4316 and a fluid orifice 4318. While relief regions 4352, 4354 are shown located at angles approximately +30° and −30° relative to datum plane 4322 and nozzle axis 4324, it should be understood that any location angles and sizes for relief regions 4352, 4354 can be used, depending on the flow characteristics of a particular PDC bit 4310 to be improved. Furthermore, it should be understood that additional relief regions can be included at ledge 4330 (e.g. FIGS. 42 and 43) to improve the flow characteristics of PDC bit 4310, if desired.

Figure 40:
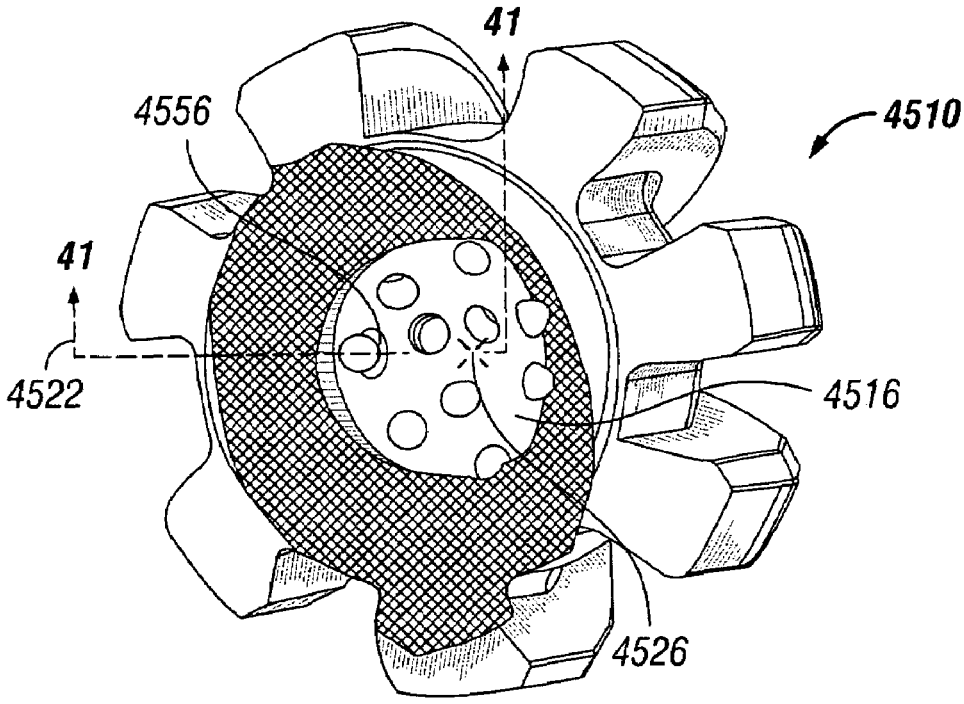
FIG. 40 shows an isometric bottom-view drawing of a fluid plenum of a PDC bit in accordance with an embodiment of the present invention.
Figure 41:
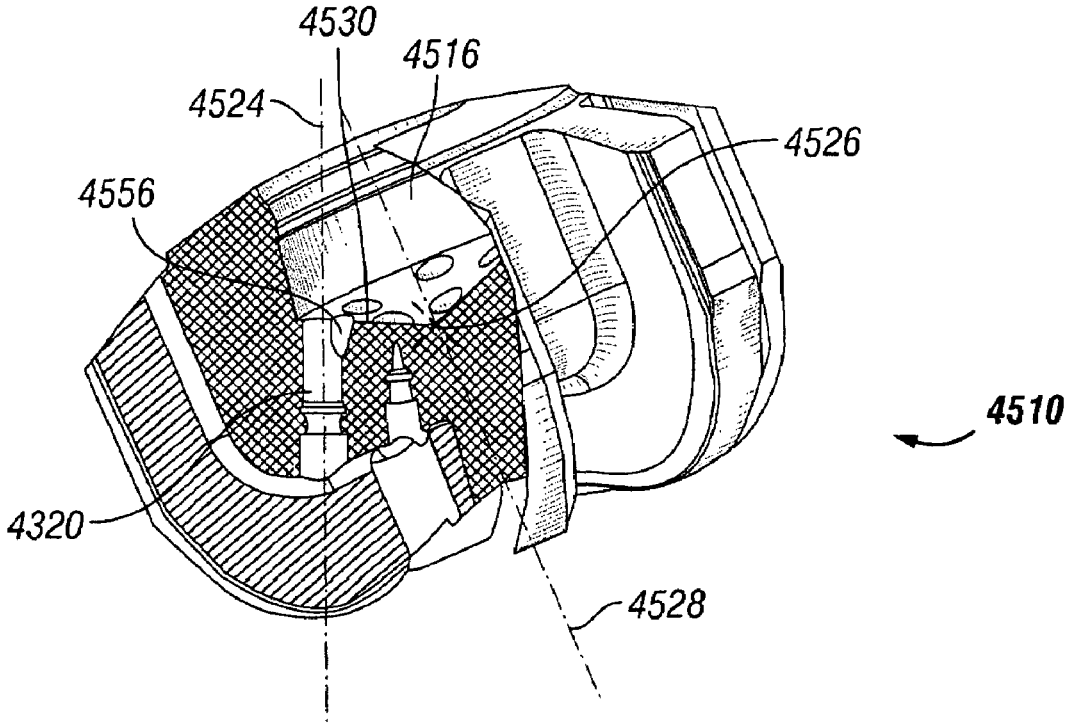
FIG. 41 shows a sectioned side-view drawing of the PDC bit and fluid plenum of FIG. 40.

Referring now to FIGS. 40 and 41, a cross-sectional view of a PDC bit 4510 is shown. Similarly to FIG. 39, FIG. 41 is a cross-sectional view of PDC bit 4510 of FIG. 40 along a datum plane 4522 defined by an axis 4524 of a nozzle port 4520 and a point 4526 defined by the intersection of the bottom of a fluid plenum 4516 with a bit axis 4528. As can be seen in FIGS. 40 and 41, a swept relief region 4556 is formed at a flow change ledge 4530 between fluid plenum 4516 and a fluid orifice 4518. Swept region 4556 has a span of approximately 180° with the center located at an angle of approximately 0° relative to reference datum plane 4522. While relief region 4556 is shown located at an angle approximately 0° relative to datum plane 4522 and nozzle axis 4524, it should be understood that any location angles and sizes for relief region 4556 can be used, depending on the flow characteristics of a particular PDC bit 4510 to be improved. Furthermore, it should be understood that the area and angle swept by relief region 4556 at ledge 4530 can be increased up to 360° or decreased to smaller angles to improve the flow characteristics of PDC bit 4510, if desired.

Figure 42:
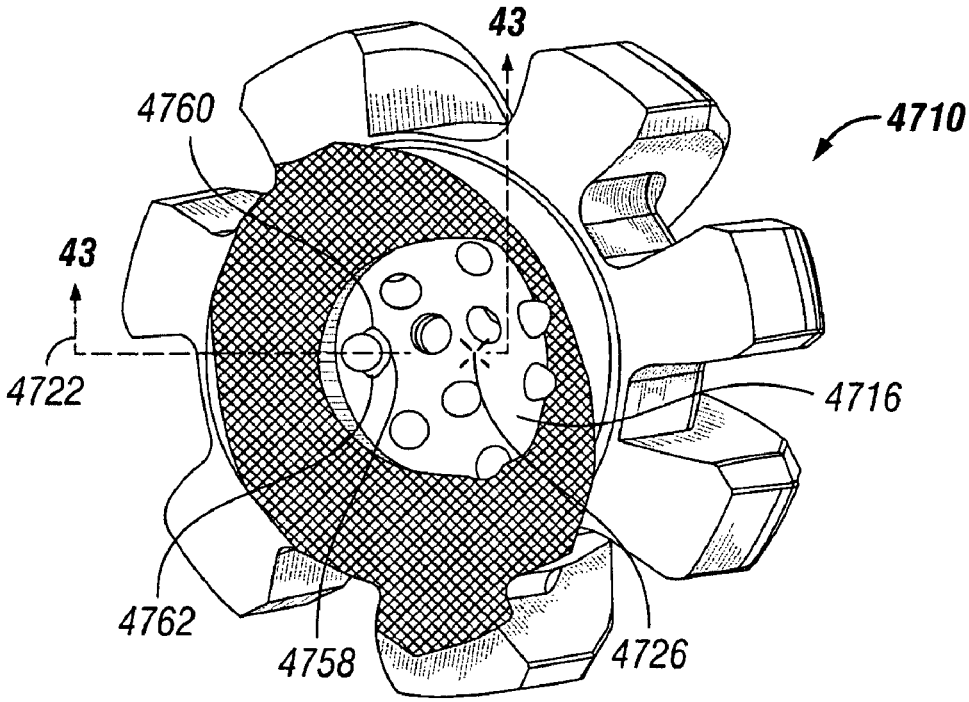
FIG. 42 shows an isometric bottom-view drawing of a fluid plenum of a PDC bit in accordance with an embodiment of the present invention.
Figure 43:
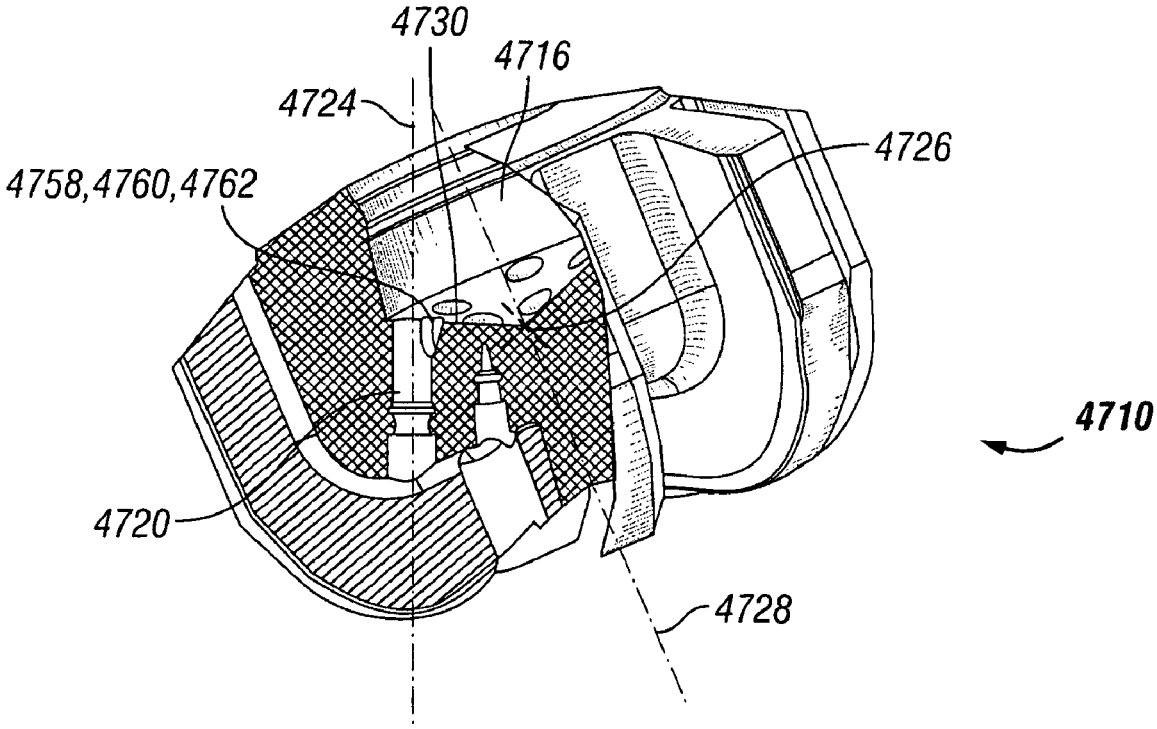
FIG. 43 shows a sectioned side-view drawing of the PDC bit and fluid plenum of FIG. 42.

Referring now to FIGS. 42 and 43, a cross-sectional view of a PDC bit 4710 is shown. Similarly to FIG. 41, FIG. 43 is a cross-sectional view of PDC bit 4710 of FIG. 42 along a datum plane 4722 defined by an axis 4724 of a nozzle port 4720 and a point 4726 defined by the intersection of the bottom of a fluid plenum 4716 with a bit axis 4728. As can be seen in FIGS. 42 and 43, three relief regions 4758, 4760, and 4762 are formed at a flow change ledge 4730 between fluid plenum 4716 and a fluid orifice 4718. While relief regions 4758, 4760, and 4762 are shown located at angles approximately 0°, +30°, and −30° relative to datum plane 4722 and nozzle axis 4724, it should be understood that any location angles and sizes for relief regions 4758, 4760, and 4762 can be used, depending on the flow characteristics of a particular PDC bit 4710 to be improved.

While various structures for PDC bits are discussed throughout this disclosure, it should be understood that embodiments of the present invention are applicable to numerous other structures. Depending on whether the PDC bit is manufactured of machined steel or sintered matrix material, the structure and geometries of fluid plenums and flow change ledges can differ substantially. Particularly, it should be understood that in a matrix metal bit, the bottom of the fluid plenum might be constructed such that a smooth transition, rather than a sharp-edged ledge, is created. In such circumstances, the ledge is approximated and relief features in accordance with embodiments of the present invention are created. As a result, absent additional modifying language to the contrary, the term "ledge" as recited in the appended claims refers to both sharp-edged and gradual transitions alike, and is therefore not intended to limit the scope thereof to any particular geometry.

While the invention has been described with respect to a limited number of embodiments, those skilled in the art, having benefit of this disclosure, will appreciate that other embodiments can be devised which do not depart from the scope of the invention as disclosed herein. Accordingly, the scope of the invention should be limited only by the attached claims.

What is claimed is:

1. An earth boring bit, comprising:

a bit body adapted to connect to a drill string, wherein the bit body includes a fluid plenum connecting a fluid inlet to at least one fluid orifice;

wherein a ledge formed between a bottom of the fluid plenum and the at least one fluid orifice has a relief region formed therein located across a flow change angle; and a plurality of PDC cutter elements mounted on the bit body.

2. The earth boring bit of claim 1, wherein the bit body is manufactured from a sintered matrix compound.

3. The earth boring bit of claim 1, wherein the bit body is manufactured from machined steel.

4. The earth boring bit of claim 1, wherein the relief region comprises a plurality of relief regions.

5. The earth boring bit of claim 1, wherein the relief region is located at an angle determined by rotating clockwise about a fluid orifice axis from a datum plane.

6. The earth boring bit of claim 5, wherein the datum plane is defined by the fluid orifice axis and a point, wherein the point is defined by an intersection of a bit axis with a bottom of the fluid plenum.

7. The earth boring bit of claim 5, wherein the angle is between 20 and 360 degrees.

8. The drill bit of claim 1, wherein the relief region comprises a first relief located at an angle between about 330 degrees and about 30 degrees and a second relief located at an angle between about 30 degrees and about 150 degrees as determined by rotating clockwise about a fluid orifice axis from a datum plane.

9. A method of improving a polycrystalline diamond compact drill bit body design having formed therein a fluid plenum in communication with a fluid inlet and at least one fluid orifice, wherein a ledge is formed between a bottom of the fluid plenum and the at least one fluid orifice, the method comprising:

determining flow change angles from the fluid plenum of the drill bit into the fluid orifice; and modeling a relief region on the ledge to optimize flow into the at least one fluid orifice.

10. The method of claim 9, further comprising determining a maximum flow change angle.

11. The method of claim 10, further comprising modeling the relief region no more than ten degrees from the location of the maximum flow change angle.

12. The method of claim 11, further comprising repeating the determining flow change and the modeling a relief region until the maximum flow change angle is less than a selected angle.

13. The method of claim 12, wherein the selected angle is less than about ninety-five degrees.

14. A method of manufacturing a polycrystalline diamond compact bit body with improved flow characteristics having formed therein a fluid plenum in communication with a fluid inlet and at least one fluid orifice, wherein a ledge is formed between a bottom of the fluid plenum and the at least one fluid orifice, the method comprising:

forming a relief region on the ledge.

15. The method of claim 14, wherein the relief region is located at an angle determined by rotating clockwise about a fluid orifice axis from a datum plane.

16. The method of claim 15, wherein the angle determined is greater than 20 degrees and less than 360 degrees.

17. The method of claim 14, wherein the relief region is formed by a rotary machining tool selected from a group consisting of mill, a drill, a chamfer cutter, and a ball end mill.

18. The method of claim 17, wherein the rotary machining tool is inserted through the at least one fluid orifice to form the relief region.

19. The method of claim 17, wherein the rotary machining tool is inserted through the fluid plenum to form the relief region.

20. The method of claim 14, wherein the relief region is a swept region.

21. The method of claim 20, wherein the swept region has an outer arcuate section having a span of at least 60 degrees and is located substantially toward a bit body axis.

22. The method of claim 20, wherein an outer arcuate section of the swept region is non-concentric with the at least one fluid orifice.

23. The method of claim 20, wherein the swept relief region increases a cross-sectional area of an entrance of the at least one fluid orifice greater than about 30 percent.

24. The method of claim 20, wherein the swept relief region is formed by a rotary machining tool selected from a group consisting of mill, a drill, a chamfer cutter, and a ball end mill.

25. The method of claim 24, wherein the rotary machining tool is inserted through the at least one fluid orifice to form the swept relief region.

26. The method of claim 24, wherein the rotary machining tool is inserted through the fluid plenum to form the swept relief region.

27. A polycrystalline diamond compact drill bit, comprising:

a bit body having a connection adapted to connect to a drill string, wherein the bit body comprises:

a fluid plenum configured to be in fluid communication with a fluid inlet and at least one fluid orifice;

a plurality of PDC cutters positioned upon the bit body; and each of the at least one fluid orifice comprising;

a fluid orifice entrance area, a relief region, a nozzle entrance area, and a nozzle receptacle, wherein the fluid orifice entrance area is at least 20 percent larger than the nozzle entrance area.

28. The drill bit of claim 27, wherein the relief region is located at an angle determined by rotating clockwise about a fluid orifice axis from a datum plane.

29. The drill bit of claim 28, wherein the angle determined is between about 20 degrees and about 360 degrees.

30. The drill bit of claim 27, wherein the relief region comprises a swept relief region.

31. The drill bit of claim 27, wherein the nozzle entrance area is substantially circular.

* * * * *